United States Patent [19]

Komatsu et al.

[11] Patent Number: 4,816,289

[45] Date of Patent: Mar. 28, 1989

[54] PROCESS FOR PRODUCTION OF A CARBON FILAMENT

[75] Inventors: Yukinari Komatsu; Katsuyuki Nakamura, both of Nobeoka, Japan

[73] Assignee: Asahi Kasei Kogyo Kabushiki Kaisha, Osaka, Japan

[21] Appl. No.: 807,355

[22] Filed: Dec. 10, 1985

Related U.S. Application Data

[63] Continuation-in-part of Ser. No. 727,213, Apr. 25, 1985, abandoned.

[30] Foreign Application Priority Data

| | | | |
|---|---|---|---|
| Apr. 25, 1984 | [JP] | Japan | 59-83495 |
| Nov. 30, 1984 | [JP] | Japan | 59-253550 |
| Nov. 30, 1984 | [JP] | Japan | 59-253551 |
| Nov. 30, 1984 | [JP] | Japan | 59-253552 |
| Mar. 23, 1985 | [JP] | Japan | 60-58810 |
| Mar. 23, 1985 | [JP] | Japan | 60-58813 |
| Mar. 23, 1985 | [JP] | Japan | 60-58816 |
| Mar. 23, 1985 | [JP] | Japan | 60-58819 |
| Mar. 23, 1985 | [JP] | Japan | 60-58820 |
| May 28, 1985 | [JP] | Japan | 60-113108 |
| Jun. 6, 1985 | [JP] | Japan | 60-123201 |

[51] Int. Cl.[4] ..... D01C 5/00; H01B 1/00

[52] U.S. Cl. ..... 423/447.3; 423/447.5; 423/447.6; 423/447.7; 423/447.8; 423/449; 252/502; 252/506

[58] Field of Search ..... 423/447.5, 447.1, 447.2, 423/447.3, 447.5, 447.6, 447.7, 447.8, 449, 252, 502, 506; 428/408, 367, 369; 502/152, 155

[56] References Cited

U.S. PATENT DOCUMENTS 3,378,345 4/1968 Bourdeau et al. ..... 423/447.5

FOREIGN PATENT DOCUMENTS 0136497 8/1984 European Pat. Off. .
60-54999 3/1985 Japan .

*Primary Examiner*—Josephine Barr
*Attorney, Agent, or Firm*—Birch, Stewart, Kolasch & Birch

[57] ABSTRACT

A carbon filament comprising carbon layers and having a carbon structure in which the carbon layers are arranged substantially in the form of growth rings as viewed in cross-section, said carbon structure having an $I_{1580}/I_{1360}$ ratio in Raman scattering spectrum of 1 or more and being readily convertible upon heating to a graphite structure. The carbon filament is efficiently produced in high yield from a hydrocarbon or a derivative thereof by a process in which specific species of catalysts are employed, preferably in combination with a filament-forming auxiliary, in specific amount proportions. The carbon filament and graphite filament are useful as filling materials for plastics, rubbers, paints, adhesives, ceramics, carbons and metals. They are also useful as an electrode material, electromagnetic wave shield, etc.

25 Claims, 8 Drawing Sheets

PROCESS FOR PRODUCTION OF A CARBON FILAMENT

This application is a continuation-in-part of our U.S. application Ser. No. 727,213 filed Apr. 25, 1985, now pending, now abandoned.

BACKGROUND OF THE INVENTION

This invention relates to a carbon filament, graphite filament, process for production thereof and various forms of the filaments. More particularly, the present invention is concerned with a carbon filament produced by the gaseous phase method, which is easily convertible to a graphite structure, a graphite filament produced by heating the carbon filament and mass forms thereof and fabricated pieces obtained therefrom. The present invention is also concerned with the use of these products.

Carbon filaments are materials which have, in recent years, been aggressively developed as the material for various kinds of composite materials due to their excellent mechanical properties. Conventionally, carbon filaments have been produced by carbonizing organic filaments. In the recent years, it has been attempted to produce carbon filaments by the gaseous phase method in which pyrolysis of hydrocarbons is utilized to form carbon filaments. The carbon filaments produced by the gaseous phase method are excellent in crystallinity and orientality as compared with the carbon filaments produced by the conventional methods. For this reason, the carbon filaments produced by the gaseous phase method not only have a high mechanical strength and high modulus but also are excellent in electrical conductivity and heat conductivity and, therefore, are expected to be useful for electrode materials, heater elements, filters, carriers for catalyst, diaphragms to be used for audio products, reinforcers for plastics, rubber, metals, carbon and ceramics, and the like.

With respect to the carbon filaments used for the conventional filament composite materials, it is known that the smaller the diameter of carbon filaments, the more excellent the reinforcing effect or integrity thereof. Such tendency is attributed to the fact that the smaller the diameter of carbon filaments, the larger the surface of carbon filaments contacting a resin or binder. The wettability of carbon filaments by a resin is not very good. Therefore, it is desirable that the diameter of carbon filaments be as small as possible. However, the carbon filaments which have been produced by the conventional methods in which acrylic fibers are calcined or pitch is made infusible have a diameter of at least about 6 to 10 μm because of difficulties in spinning the precursor filaments.

Carbon filaments produced by pyrolysis of hydrocarbon compounds are described in Japanese Patent Application Laid-Open Specification No. 47-20418/1972 and the method of pyrolysis of hydrocarbon compounds is described in Japanese Patent Application Publication No. 41-12091/1966. However, the carbon filaments disclosed in these references comprise polycrystalline graphites having a laminate structure in which pipe-like graphites are closely mixed with helical graphites and they are present around a fine columnar graphite as an axis, which structure is different from the growth ring structure. Further, the carbon filaments disclosed in the above references have a diameter of several μm to several hundred μm, which diameter is not small enough.

Moreover, in the above references, there is not such a description that the carbon filaments have crimps. Still further, the inventions of the above references do not use the catalyst, such as metals, in producing carbon filaments.

U.S. Pat. No. 2,796,331 discloses that carbon filaments can be obtained by pyrolyzing a gas mixture of 20 to 80% methane and 80 to 20% hydrogen gas at1,150° to 1,450° C. for 0.4 to 15 seconds and that hydrogen sulfide is added in a proportion of 0.3 to 4% as a catalyst. However, in this reference as well, metals and the like are not used as a catalyst.

U.S. Pat. No. 3,378,345 discloses that a hydrocarbon gas is pyrolyzed at 700° to 1,200° C. in the presence of a hydrogen gas mixture containing carbon dioxide or water at a concentration of $2.5\times10^{-3}$ to 0.1% by weight to grow a nucleus and then the nucleus is further grown at a temperature of 1,200° C. or more to form graphite whiskers. The process of this reference is not one in which metals and the like are used as a catalyst.

Japanese Patent Application Laid-Open Specification No. 52-103528 discloses a method that (i) particles of a transition metal, an oxide thereof or a carbide thereof are scattered over a heat resistant substrate plate, (ii) the substrate plate is placed in an electric furnace and the temperature is raised to a level of 1,030° to 1,300° C. and (iii) a stream of a gas mixture of hydrocarbon compounds and hydrogen is supplied into the electric furnace to effect pyrolysis, thus forming carbon filaments on the substrate plate. In this method, particles of a transition metal and the like serve as the nucleus of growth. Such particles are often widely varied in diameter and it is difficult to scatter the particles over the surface of the substrate plate uniformly. Therefore, the carbon filaments produced by this method generally have a diameter of as large as 10 μm or more and the diameter is widely varied. Even if fine carbon filaments are obtained, the lengths of the carbon filaments are short and the carbon filaments have no crimp and difficult to be collected. Further, even if the carbon filaments are subjected to surface oxidation treatment which is intended to improve the adhesiveness between the carbon filament and a resin, the surface of the carbon filaments is difficult to oxidize. Still further, when the carbon filaments produced by this method are used for a metal composite material, the metal composite material in which the carbon filaments produced by this method are used is liable to release the gas inside the metal composite material because the carbon filaments have large hollow portions inside the same. The carbon filaments produced by this method have good graphitizability as compared with PAN type carbon filaments and pitch type carbon filaments. However, the carbon filaments at issue are composed of a large number of kinds of carbons and it is difficult to convert them into graphite filaments.

Japanese Patent Application Laid-Open Specification No. 58-180615/1983 discloses a method in which ultra fine powders of a metal having a high melting point, for example a metal which does not sublimate at 950° to 1,300° C., an oxide thereof, nitride thereof, salt thereof or the like are suspended in a zone for pyrolyzing hydrocarbon compounds to grow carbon filaments. However, the carbon filaments obtained by this method have many branched portions because when the ultra fine powder adheres to a carbon filament in the course of growth, a branched carbon filament grows from the portion to which the ultra fine powder adhered. Further, the diameter of the carbon filaments is large and the carbon filaments have a large hollow portion and no crimp. Still further, not only the activity of the catalyst is low but also the catalyst cannot be sufficiently suspended in a zone for pyrolyzing hydrocarbon compounds because previously produced ultra fine powders as the catalyst are dispersed in a volatile solvent and then used. Therefore, in this method, the yield is insufficient and carbon filaments having a small diameter cannot be obtained efficiently.

Moreover, a process for preparing carbon filaments in a gaseous phase method in which a mixture of a gaseous organic metal compound and a carrier gas or a mixture of a gaseous carbon compound, a gaseous organic metal compound and a carrier gas is reacted has been proposed in European Patent Application Publication No. 136 497 with a view to obviating the above-mentioned drawbacks of the conventional processes. However, this process as well does not ensure efficient production of desirable carbon filaments in high reproducibility.

As is apparent from the foregoing, there have not been obtained desirable carbon filaments which have a small enough diameter and only a few branched portions are uniform in diameter and, therefore, have a sufficient reinforcing effect. Further, there have not been produced desirable carbon filaments of short length for reinforcement which have not only such a high graphitization degree that the carbon filaments are advantageously used as an electrically conductive material, but also a ratio of filament length to filament diameter sufficient to exhibit a reinforcing effect.

SUMMARY OF THE INVENTION

To develop such desirable carbon filaments, intensive studies have been made on the effects of reaction temperature, time, supply system, catalysts, raw materials, apparatus, carrier gas and the like on the yield of the carbon filaments.

As a result, it has been unexpectedly found that desirable carbon filaments can be efficiently obtained in high yield by a gaseous phase method in which a specific species of catalysts are employed, preferably in combination with a filament-forming auxiliary, in specific amount proportions. Based on this novel finding, we have now completed this invention.

Accordingly, it is an object of the present invention to provide a carbon filament comprising carbon layers having a carbon structure in which the carbon layers are arranged substantially in parallel with the longitudinal axis of the filament and arranged substantially in the form of growth rings as viewed in cross-section of the filament, the carbon structure being convertible to a graphite structure, and a graphite filament produced by subjecting the carbon filament to heat treatment.

It is another object of the present invention to provide a carbon filament and a graphite filament which not only have an extremely small diameter and only a few branched portions uniform in diameter but also have a ratio of filament length to filament diameter sufficient to exhibit a reinforcing effect.

A further object of the present invention is to provide a carbon filament and a graphite filament which are highly crimped, composed of a few kinds of carbon and homogeneous and which has such a small hollow portion in the center of the filament that the filaments are regarded as substantially solid filaments.

It is a further object of the present invention to provide a carbon filament and a graphite filament which are excellent in electrical conductivity and heat conductivity and which are capable of being easily oxidized as compared with the conventional carbon filament obtained by pyrolyzing hydrocarbons.

It is still a further object of the present invention to provide a carbon filament and a graphite filament which are adapted to be easily shaped into a sheet and which are suitable for use as a filling material for plastic, rubber, paint, adhesive, ceramics, carbon or metal.

Yet, still a further object of the present invention is to provide a carbon filament and a graphite filament which exhibit an excellent performance as an electrode material.

Still a further object of the present invention is to provide a carbon filament and a graphite filament which are excellent in moldability and capable of being easily supplied to an extruder or the like.

Another object of the present invention is to provide mass forms of the above-mentioned filaments which are excellent in moldability.

Still another further object of the present invention is to provide an easy process for producing carbon filaments exhibiting high performances and at a low cost.

BRIEF DESCRIPTION OF DRAWINGS

The foregoing and other objects, features and advantages of the present invention will be apparent to those skilled in the art from the following detailed description taken in connection with the accompanying drawings in which.

DETAILED DISCUSSION

Figure 1:
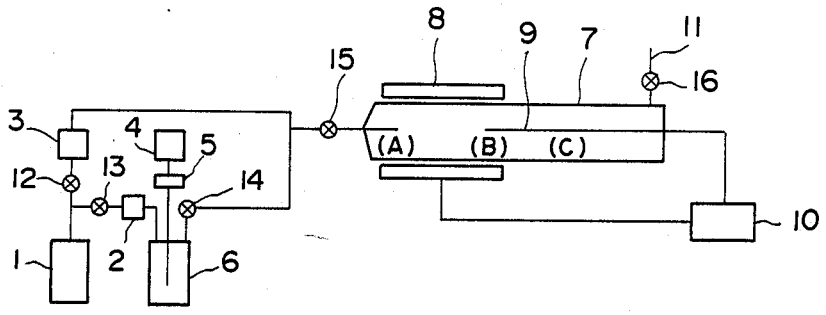
FIG. 1 is a diagrammatic view of one form of an apparatus used for producing a carbon filament of the present invention.

In one aspect of the present invention, there is provided a carbon filament comprising carbon layers and having a carbon structure in which the carbon layers are arranged substantially in parallel with the longitudinal axis of the filament and arranged substantially in the form of growth rings as viewed in cross-section of the filament, the carbon strucure exhibiting peaks at 1580 $cm^{-1}$ and at 1360 $cm^{-1}$ in the Raman scattering spectrum, the ratio ($I_{1580}/I_{1360}$) of the height of the peak at 1580 $cm^{-1}$ to that at 1360 $cm^{-1}$ being 1 or more, the carbon structure being convertible, upon heating in an argon gas atmosphere at 2400° C. for 20 minutes, to a graphite structure in which planar hexagonal carbon network layers (002) are stacked at interlayer spacings ($d_{002}$) of 0.345 nm or less as measured according to powder X-ray diffractometry and which has a crystallite size (Lc) of 15 nm or more.

In another aspect of the present invention, there is provided a carbon filament comprising carbon layers and having a carbon structure in which the carbon layers are arranged substantially in parallel with the longitudinal axis of the filament and arranged substantially in the form of growth rings as viewed in cross-section of the filament, the carbon structure being convertible, upon heating in an argon gas atmosphere at 2400° C. for 20 minutes, to a graphite structure in which planar hexagonal carbon network layers (002) are stacked at interlayer spacings ($d_{002}$) of 0.345 nm or less as measured according to powder X-ray diffractometry and which has a crystallite size (Lc) of 15 nm or more.

the carbon filament having at least one crimp per 20 μm in filament length and exhibits a crimping degree of from 5 to 50%.

In still another aspect of the present invention, there is provided a graphite filament having a diameter of from 0.01 to 15 μm and a ratio of filament length to filament diameter of 20 or more, the filament having a crimping degree of from 5 to 50%, the filament comprising planar hexagonal carbon network layers and having a graphite structure in which the layers are arranged substantially in parallel with the longitudinal axis of the filament and arranged substantially in the form of growth rings as viewed in cross-section of the filament, the graphite structure exhibiting peaks at 1580 $cm^{-1}$ and at 1360 $cm^{-1}$ in the Raman scattering spectrum, the ratio ($I_{1580}/I_{1360}$) of the height of the peak at 1580 $cm^{-1}$ to that at 1360 $cm^{-1}$ being 1.5 or more, the graphite structure having a crystallite size (Lc) of 15 nm or more and exhibiting a $C_{ls}$ band half-width in electron spectroscopy for chemical analysis (ESCA) of 1.6 eV or less, the planar hexagonal carbon network layers (002) being stacked at interlayer spacings ($d_{002}$) of 0.345 nm or less as measured according to powder X-ray diffractometry.

The diameter of the carbon filament of the present invention is in the range of from 0.01 to 15 μm, preferably 0.05 to 4 μm, more preferably 0.07 to 2 μm. The diameter of the carbon filament may be determined by means of scanning electron microscope and optical microscope.

The uniformity of diameter of a carbon filament is evaluated in terms of deviation of diameter of each filament. In the present invention, the deviation of diameter of each carbon filament having a diameter of from 0.01 to 0.9 μm is, for example, within ±10% and that of a carbon filament having a diameter of 1 μm or more within ±30% as measured according to a method in which carbon filaments are observed under a microscope at a magnification of 1000 to 10,000, and the diameters of each filament within the range of microscope are measured along the direction of length of each filament. The length of the carbon filament of the present invention is in the range of generally from 20 μm to 20 mm, preferably from 50 μm to 5 mm, more preferably from 100 μm to 5 mm.

The ratio of filament length to filament diameter is 20 or more, preferably 100 or more, more preferably 1,000 to 5,000. When the ratio of filament length to filament diameter is less than 100, the form-keeping property is not so good but the electrical conductivity is excellent and, therefore, can be advantageously used instead of carbon black. On the other hand, when the ratio of filament length to filament diameter is 100 or more, the filaments contact each other in many points and, therefore, are useful as an electrode material, electrically conductive filler or reinforcing filler.

The carbon filament of the present invention has little branched portions. A typical carbon filament of the present invention has semispherical shapes at both its ends, and has at least a little hollow portion along the center-axis of the filament but substantially solid in cross-section. When such a carbon filament is used as a reinforcing material for a metal and the like, defects observed in the conventional carbon filaments are not caused because gases are hardly contained in the hollow portions of the filament and, therefore, little gases are released from the filament. According to need, branched portions may be formed in the carbon filament by, for example, placing carbon filaments having little branched portions in a furnace, supplying hydrocarbon compounds and derivatives thereof to the furnace to effect pyrolysis and thereby adhering pyrolyzed carbon to the points of contact between carbon filaments. By this method, carbon filaments adhere to each other so that carbon filaments having branched portions are formed.

The carbon filament of the present invention has crimps. In other words, the carbon filament is randomly crimped and has a zigzag configuration. In the present invention, the carbon filament has at least one crimp, preferably 2 or more crimps per 20 μm in filament length and exhibits a crimping degree of from 0.5 to 50%, more preferably 5 to 50%.

The number of crimps may be determined by means of electron micrograph (magnification: 1,000 to 10,000). Number of crimps used herein is expressed in terms of the total number of crests and troughs of filament per 20 μm in filament length.

The "crimping degree" used herein is determined using an electron micrograph as follows. First two points, a and b, on a filament is chosen so that the distance in a straight line between a and b is 40 μm. Second, the distance along the filament between a and b is measured by means of planimeter. Then, the "crimping degree" is calculated according to the following equation:

$$\text{Crimping degree (\%)} = \frac{ab - 40}{ab} \times 100$$

wherein ab: distance along the filament between a and b (μm). The value of "crimping degree" is an average value of 5 measurements randomly made.

When the number of crimps and crimping degree are large, the filaments are highly intertwined with each other in a three-dimensional manner, not only leading to improvement in electrical conductivity when mixed with a resin, but also facilitating sheet-making.

In the present invention, when the number of crimps per 20 μm in filament length is less than 1 and the crimping degree is less than 0.5%, the intertwinemet between filaments is decreased in the case where the filaments are used as a composite material of a component of a resin composition, so that sufficient electrical conductivity is difficult to attain.

With respect to the crimped carbon filament of the present invention, the peak height ratio $I_{1580}/I_{1360}$ in the Raman scattering spectrum is not especially critical. However, the crimped carbon filaments having a ratio as mentioned above of 1 or more are preferred because they are more active in electrochemical reactions.

The carbon layers of the carbon filament contain planar hexagonal carbon network layers (002) which are disposed at interlayer spacings ($d_{002}$) greater than 0.345 nm but not greater than 0.36 nm, preferably in the range of from 0.35 to 0.36 nm, and the carbon structure has a crystallite size (Lc) smaller than 15 nm, particularly in the range of from 1 nm to 10 nm. The above interlayer spacing ($d_{002}$) and Lc size are determined according to the powder X-ray diffractometry.

The carbon structure of the carbon filament is convertible, upon heating in an argon gas atmosphere at 2400° C. for 20 minutes, to a graphite structure in which planar hexagonal carbon network layers (002) are stacked at interlayer spacings ($d_{002}$) of 0.34 nm or less as measured according to powder X-ray diffractometry and which has a crystallite size (Lc) of 15 nm or more.

The power X-ray diffractometry is carried out using Geigerflex RAD-rA (tradename of an apparatus manufactured and sold by Rigaku Denki K.K., Japan) (Cu-Kα, 150 mA, 40 kV) provided with a monochromator.

Samples obtained by finely powdered carbon filaments are subjected to the powder X-ray diffractometry. The determination is made over a range of 15° to 35° (2θ) in a step scan manner (Step Width: $2\theta/\theta=0.01$ DEG, Preset Time: 0.4 sec) according to the reflection method.

The carbon structure of the carbon filament exhibits peaks at 1580 $cm^{-1}$ and at 1360 $cm^{-1}$ in the Raman scattering spectrum, the ratio ($I_{1580}/I_{1360}$) of the height of the peak at 1580 $cm^{-1}$ to that at 1360 $cm^{-1}$ being 1 or more, preferably 1.01 or more, more preferably 1.05 or more. The Raman scattering spectrum is determined by the Raman spectrometry ["Carbon Material Experimental Technique" p.75 (June 1, 1978) Kagakugijutsu-sha, Japan]. In the present invention, the carbon filament having a small diameter may exhibit a ratio ($I_{1580}/I_{1360}$) of height of the peak at 1580 $cm^{-1}$ to that at 1360 $cm^{-1}$ of 1.1 or more.

With respect to the filament obtained by subjecting the carbon filament to heat treatment for graphitization, the above-mentioned ratio may be 1.1 or more, and increases to 1.5 or more with the increase of temperature and time of the heat treatment. In this connection, the more the structure of the filament comes close to that of single crystal of graphite, the more the position of the lower peak may deviate from 1,580 $cm^{-1}$ to 1,575 $cm^{-1}$ and similarly the position of the higher peak may deviate from 1,360 $cm^{-1}$ to 1,355 $cm^{-1}$.

Usually, the single crystal of natural graphite exhibits one peak at 1,580 $cm^{-1}$ in the Raman scattering spectrum, and the artificial graphite composed of crystallites and the carbon having no graphite structure, such as glassy carbon, have not only one peak at 1,580 $cm^{-1}$ but also one band peak at 1,360 $cm^{-1}$ in the Raman scattering spectrum. That is, the ratio of the height of the peak in the Raman scattering spectrum at 1,580 $cm^{-1}$ to that at 1,360 $cm^{-1}$ ($I_{1580}/I_{1360}$) closely relates to the extent of structural defect in the carbon substance or the irregularity of crystal lattice of a carbon substance. Small value of $I_{1580}/I_{1360}$ means that the extent of structural defect in the carbon substance is large, and the large value of $I_{1580}/I_{1360}$ means that the carbon substance is close to graphite crystal in structure.

In the present invention, the determination of Raman scattering spectrum was carried out using NR-1000 (an apparatus manufactured and sold by Japan Spectroscopic Co., Ltd., Japan) under the following conditions:

Laser: Ar Laser (514.5 nm, 500 mW)
Slit:
Entrance 500 μm
Intermediate 550 μm
Exit 500 μm
Sample: Carbon filament is powdered and Shaped into KBr tablet.
Cell: rotating cell The carbon structure of the carbon filament of the present invention exhibits a $C_{ls}$ band half-width in electron spectroscopy for chemical analysis (ESCA) of 1.6 eV or less, preferably 1.30 to 1.50 eV as measured according to electron spectroscopy for chemical analysis (ESCA) ["Carbon Material Experimental Technique (I)" p.64 (June 1, 1978) Kagakugijutsu-sha, Japan]. In this connection, the $C_{ls}$ band is a band peak appearing at 283.7 eV in ESCA.

With respect to the filament obtained by subjecting the carbon filament to heat treatment for graphitization, the $C_{ls}$ band half-width in ESCA decreases from 1.30 eV to 1.28 eV or less, preferably 1.20 eV or less with the increase of temperature and time of the heat treatment.

The determination of ESCA is carried out using PHI MODEL 550 ( trade name of an apparatus manufactured and sold by Physical Electronic Inc., USA) under the following conditions:

Radiation source : Mg - Kα
mA - kV: 40 - 10
Degree of vacuum: $10^{-9}$ torr
Sample: Filaments are powdered by means of ball mill, then placed on a sample carrier and fixed by means of double-coated tape.

The binding energy is determined using gold as the standard.

It is observed by means of electron microscope that the carbon layers of carbon filament of the present invention are arranged substantially in parallel with the longitudinal axis of the filament and arranged substantially in the form of growth rings as viewed in cross-section of the filament.

With respect to the filament obtained by subjecting the carbon filament to heat treatment for graphitization, it is observed by means of electron microscope that with the increase of temperature and time of the heat treatment, plannar hexagonal carbon network layers are developed in cross-section so that the cross-section of the filament tends to be polygonal. In the present invention, the "growth rings" includes such structure.

The desirable carbon filament as defined above may be produced by selecting appropriate reaction conditions, for example, 0.01 to 3% by weight as the amount of organic transition metal compound relative to the hydrocarbon, 1000° to 1800° C. as the reaction temperature, less than 8 g/l as the weight of hydrocarbon relative to the volume of carrier gas, as elucidated later.

In the present invention, the carbon filament may be produced using an organic transition metal compound as a catalyst. Therefore, a metal may be contained in the obtained carbon filament. The content of the metal in the filament may be easily controlled by varying the ratio of the amount of the organic transition metal compound to that of hydrocarbons in producing. The content of the metal in the filament is not critical but generally the carbon filament comprises a transition metal in an amount of from 0.01 to 10% relative to the total weight of the filament. Usually, the content of the metal in the filament does not exceed 0.03%. However, according to need, it is possible to increase the above-mentioned content to 10% or more by increasing the amount of the transition metal used in the process of the present invention, which will be described later. The carbon filament of the present invention may be advantageously used as a material for shielding electromagnetic waves.

The carbon filament of the present invention exhibits an extremely high reactivity and, especially, can stably contain acid functional groups such as carboxyl groups. The concentration of acid functional groups in the filament may be 0.01 to 500 μmol/g, preferably 0.1 to 200 μmol/g, more preferably 0.1 to 50 μmol/g. The concentration of acid functional groups in the filament may be determined by the titration method as follows: About 5 g of sample is weighed and put in a 500 ml - Erlenmeyer flask with ground stopper. 100 ml of water and 40 ml of 1/50 N NaOH are accurately pipetted into the flask and 60 ml of water is added to make up 200 ml. The obtained solution is allowed to stand for 20 minutes with occasional shaking and then immersed in an ultrasonic vibrator for 5 minutes. Then 50 ml of the solution is pipetted into a round bottom flask and titrated with 1/50 N HCl. The concentration of a functional group is determined from the titration curve obtained using a potentiometric titration apparatus (Model RAT-11; manufactured and sold by Hiranuma Chem., Japan).

At a concentration of the acid functional groups less than 0.01 μmol/g, sufficient adhesion between the filament and the resin, binder or the like cannot be attained when the filament is mixed with a resin, binder or the like and used. On the other hand, when the concentration of the acid functional groups is more than 500 μmol/g, the above-mentioned features of the carbon filament are lost.

In the carbon filament of the present invention, the oxygen concentration as measured according to ESCA, that is, the relative integrated intensity of $O_{ls}$ relative to $C_{ls}$ ($O_{ls}/C_{ls}$) may be 0.05 or more, preferably 0.07 or more, more preferably 0.1 or more. The relative integrated intensity is herein determined using an electron spectrometer under the following conditions:

Radiation source: Mg - Kα
mA - kV: 40 - 10
Temperature: 40° C.
Degree of vacuum: $10^{-9}$ torr The ratio of the integrated intensity of $O_{ls}$ relative to that of $C_{ls}$ is calculated from the ESCA spectrum and regarded as an index of concentration of a functional group containing oxygen on the surface of carbon filaments. When the ratio of the integrated intensity of $O_{ls}$ relative to that of $C_{ls}$ is less than 0.05, the adhesion between the carbon filament and a resin or the like is decreased because the concentration of an acid group is too low.

The acid functional group may be introduced into the carbon filament according to the known method such as the gas phase oxidation method, the electrolyte phase oxidation method, the oxydizing agent solution phase-oxidation method, the plasma treatment method or the like. Illustratively stated, in the case of the gas phase oxidation method in which air, oxygen, ozone or the like is employed, when ozone of them is used, the ozone concentration may be preferably be 0.1 to 5% by weight and the temperature may preferably be 30° to 300° C. In the same method, when air is used, the introduction of an acid functional group may generally be carried out in an atmosphere of air heated to 350° to 800° C. According to need, oxygen diluted with an inert gas may be supplied to control the concentration of oxygen in air. In the case of the electrolyte phase oxidation method, carbon filaments are used as an anode and voltage is applied across the anode and a cathode plate to effect introduction of an acid functional group. In the case of the oxydizing agent solution phase-oxidation method, an oxydizing agent such as nitric acid, hypochlorous acid, a chromate, a dichromate, chromic anhydride, a permanganate or the like is dissolved in water or an organic solvent and, according to need, the obtained solution is heated. The carbon filament is treated with such a solution. In the case of plasma treatment method, glow discharge may be effected while a gas mixture containing oxygen, for example a gas mixture comprising oxygen, carbon monoxide, carbon dioxide and, according to need, an organic compound is circulated in an internal electrode type low-temperature plasma generator containing a pair of discharge electrodes under reduced pressure. In this case, the concentration of oxygen in the gas mixture may preferably be 10% by weight or more. The introduction of the acid functional group may also be effected by subjecting carbon filaments to plasma treatment using an inert gas such as helium, neon, argon, nitrogen or the like and then bring the thus treated carbon filaments into contact with an unsaturated carboxylic acid. The pressure in the plasma generator may preferably be 0.001 to 10 torr. Under such a pressure, a stable glow discharge can be effected by applying a power of 10 to 100 kW in the frequency of 10 KHz to 10 MHz across the pair of electrodes. In addition to the above-mentioned high frequency range, low-frequency, microwave, direct current and the like may be employed to effect glow discharge.

A large amount of an acid group such as carboxyl group, phenolic hydroxyl group or the like may be introduced under mild conditions without weight loss because the reactivity of the carbon filament as a raw material is high.

In the carbon filament having acid groups of the present invention, the carbon filament can have a large amount of an acid functional group without sacrificing the features of the carbon filament per se. Therefore, when the carbon filament is mixed with a resin to produce a composite material, the adhesion between the carbon filament and a resin (especially an epoxy resin and the like) is excellent. For this reason, the carbon filament of the present invention may be advantageously used as the material for a composite material to be used for parts having electrical conductivity-controlling characteristics of office automation devices, electrode materials for which high electrical conductivity is required, parts which are used in a field (relating to an engine of an automobile) in which superheat is generated, and parts which are used in a field in which high heat conductivity is required.

In still another aspect of the present invention, there is provided a mass form of a carbon filament comprising a plurality of carbon filaments, according to the present invention, entangled together and having a bulk density of from 0.008 to 0.7 g/cm$^3$, the carbon filament having a diameter of from 0.05 to 4 μm.

In a further aspect of the present invention, there is provided a mass form of a graphite filament comprising a plurality of graphite filaments, according to the present invention, entangled together and having a bulk density of from 0.008 to 0.7 g/cm$^3$, the graphite filament having a diameter of from 0.05 to 4 μm.

The diameter of carbon filaments constituting the mass form may be 0.05 to 4 μm, preferably 0.07 to 3 μm, more preferably 0.1 to 2 μm.

The carbon filaments constituting the mass form have a ratio of filament length to filament diameter of 20 or more and few branched portions,and are uniform in thickness.

The bulk density of the carbon filaments constituting the mass form may be 0.008 to 0.7 g/cm$^3$, preferably 0.01 to 0.5 g/cm$^3$, more preferably 0.05 to 0.1 g/cm$^3$.

The mass form of a carbon filament comprising a vast plurality of carbon filaments of the present invention is excellent in flexibility and moldability (processability) and, therefore, may be easily shaped into a filter or the like by the known method. The mass form of a carbon filament of the present invention may be processed to obtain a carrier of catalyst. The mass form of a carbon filament may be subjected to heat treatment to obtain graphitized mass form. The thus obtained mass form may be used as an electrode material for a cell which is good in permeability with respect to the electrolyte. The molded form of the mass form of a carbon filament may be impregnated with a thermosetting resin, a thermoplastic resin or a rubber to form a prepreg sheet. The mass form of a carbon filament may usually be obtained by causing the formed filaments to be heaped in the heating zone or in the rear thereof inside the furnace tube in the case where a transverse furnace is employed. On the other hand, it may be readily obtained by installing a filter or the like in the case of a vertical furnace. Generally, the bulk density of the heaped mass form is approximately in the range of from 0.008 to 0.1 g/cm$^3$. The bulk density can be increased, for example, to 0.1–0.7 g/cm$^3$ by means of a pressure molding or the like. Using a suitable tool (frame), the mass form can be formed into a sheet material. Filaments having crimps, even if they are not in the form of a mass, are excellent in moldability and can be shaped into a desirable form. Such filaments may be mixed with other kinds of filaments such as those of cellulose and polyvinyl alcohol according to need to make a sheet material.

The mass form of a carbon filament of the present invention is good in retaining an organic solvent such as acetone and benzene, and is easily impregnated with a resin.

The bulk density is determined as follows. 100 mg of a mass form of a carbon filament is put in a 10 ml - measuring cylinder having an inside diameter of 10 mm, and a load of 150 g (about 190 g/cm$^2$) is applied. Then, the volume of the mass form is measured and the bulk density in terms of g/cm$^3$ is calculated.

The mass form and sheet material of a carbon filament or a graphite filament according to the present invention may be used to prepare a prepreg or preform together with a synthetic resin, adhesive, rubber or the like. The filament content of the prepreg or preform may be varied widely. However, it is generally in the range of from 0.5 to 99.5% by weight.

In a still further aspect of the present invention, there is provided a carbon filament composite material comprising a bonding agent and a plurality of carbon filaments of the present invention bonded together thereby, the amount of the carbon filaments relative to the bonding agent being in the range of from 0.5 to 99.5% by weight, the carbon filament having a diameter of from 0.05 to 4 μm and a length of 200 μm or less.

In an additional aspect of the present invention, there is provided a graphite filament composite material comprising a bonding agent and a plurality of graphite filaments bonded together thereby, the amount of the graphite filaments relative to the bonding agent being in the range of from 0.5 to 99.5% by weight, the graphite filament having a diameter of from 0.05 to 4 μm and a length of 2000 μm or less.

In an even further aspect of the present invention, there is provided a paint or adhesive composition comprising a liquid medium and, dispersed therein, a carbon filament or graphite filament of the present invention and a binder.

The carbon filament or graphite filament content of the composition may be varied widely. However, it is generally in the range of from 0.5 to 90% by weight.

Moreover, a composite structural material may be prepared from a carbon filament or graphite filament mass form and composite material with the above-mentioned bulk density or from those in the form of a sheet. In such cases, the filament content of the structural material may be varied widely from 0.5 to 99.5% by weight. However, it is generally in the range of from 0.5 to 80% by weight.

The carbon filament composite material of the present invention is improved in incorporation facility into an extruder in supplying the carbon filament composite material to an extruder and is adapted to be easily dispersed in a matrix resin.

The length of the carbon filament may be 2,000 μm or less, preferably 1,000 μm or less.

In the present invention, the carbon filaments may be produced under suspension condition and thus the produced carbon filaments may form a cotton-like mass of filaments.

The mass form of the carbon filaments may then be broken into filaments using a wet or dry mill to an extent that the bulk density of the filaments reaches from 0.05 to 0.1 g/cm$^3$. In order to facilitate the supply of the carbon filaments for an extruding machine, a bonding agent may be added to the thus broken filaments so that the bulk density is increased and adjusted to from 0.1 to 1.0 g/cm$^3$. If carbon filaments having a bulk density of less than 0.1 g/cm$^3$ are intended to supply for an extruding machine, a bridge of the filaments may occur to disturb the supply thereof. On the other hand, when the bulk density is higher than 1.0 g/cm$^3$, air bubbles are liable to be included in the extruded products.

Preferred bonding agents are those having a good compatibility with and adhesive properties to both the carbon filaments and a matrix resin. As the bonding agent, there may be employed any known thermoplastic resins, thermosetting resins, derivatives thereof and rubbers. For example, an epoxy resin such as bisphenol A-type epoxy resin and precursors thereof may be used for an epoxy matrix, and a modified nylon resin or epoxy resin may be used for a nylon matrix.

The amount of the carbon filament or graphite filament relative to that of the bonding agent may be in the range of from 0.5 to 99.5% by weight, preferably from 1 to 70% by weight.

The method of incorporating the bonding agent into the carbon filaments is not critical. In one method, the bonding agent is sprinkled over the filaments, followed by mixing, and in another method, the filaments are dipped in the bonding agent or a solution thereof.

It is also possible to carry out the above-mentioned milling and incorporation of the bonding agent simultaneously or consecutively.

In an even further aspect of the present invention, there is provided a process for producing a carbon filament which comprises:

supplying at least one member selected from the group consisting of hydrocarbons and derivatives thereof to a heating zone; and heating the at least one member in the presence of an organic transition metal compound at a temperature of 400° to 3000° C. in the heating zone, the organic transition metal compound having a metal-carbon bond and being employed in an amount of from 0.01 to 5% relative to the weight of said at least one member.

In a still even further aspect of the present invention, there is provided a process for producing a carbon filament which comprises:

supplying at least one member selected from the group consisting of hydrocarbons and derivatives thereof to a heating zone; and heating the at least one member in the presence of a transition metal salt or complex at a temperature of from 400° to 3000° C. in the heating zone, the transition metal salt or complex being employed in an amount of from 0.01 to 10% relative to the weight of the at least one member, the transition metal salt or complex having a metal-oxygen bond and/or a metal-sulfur bond and being prepared from a transition metal and an organic compound, the transition metal being a member selected from the group consisting of metals having an atomic number of from 22 to 30 and from 40 to 48.

The latter process is advantageous in that the yield per unit time is improved and that it is suited for production on a commercial scale. In this process as well, a filament-forming auxiliary may be preferably employed in combination with the transition metal salt or complex.

The organic transition metal compound to be used in the present invention may contain, as the metal component, for example, a metal selected from metals belonging to the Group IVb of the Periodic Table, especially titanium and zirconium, the Group Vb, especially vanadium, the Group VIb, especially chromium, molybdenum and tungsten, the Group VIIb, especially manganese, the Group VIII, especially iron, cobalt, nickel, ruthenium, rhodium, palladium, osmium, iridium and platinum. It is preferred that the transition metal of the transition metal salt or complex to be used in the present invention be selected from the group consisting of metals having an atomic number of from 22 (Ti) to 30 (Zn) and from 40 (Zr) to to 48 (Cd), especially from the group consisting of Ti, V, Cr, Mn, Co, Ni, Fe, Cu, Zr, Nb, Mo, Tc, Ru, Rh and Pd, more especially from the group consisting of Fe, Co and Ni. The organic transition metal compound and transition metal salt or complex may be solid, liquid or gas at room temperature. Preferred are cyclopentadienyl compounds of a transition metal, carbonyl compounds of a transition metal, benzene transition metal compounds, alkyl, allyl or alkynyl compounds of a transition metal, $\beta$-diketone and $\beta$-ketonic ester complexes of a transition metal, carboxylic and thiocarboxylic salts of a transition metal, alkoxides, phenoxides, thioalkoxides and thiophenoxides of a transition metal, substituted compounds or derivatives thereof and the like.

As the cyclopentadienyl compounds of a transition metal, there may be mentioned, for example, dicyclopentadienyl iron (ferrocene), dicyclopentadienyl nickel (nickelocene), di(methylcyclopentadienyl) nickel, dicyclopentadienyl cobalt (cobaltocene), dicyclopentadienyl titanium, dicyclopentadienyl vanadium, dicyclopentadienyl chromium, dicyclopentadienyl manganese, dicyclopentadienyl rubidium and the like.

As the carbonyl compound of a transition metal, there may be employed a carbonyl compound of a metal selected from metals belonging to the group consisting of V, Nb, Ta, Cr, Mo, W, Mn, Tc, Re, Fe, Co, Ni, Ru, Rh, Os and Ir, more preferably consisting of V, Cr, Mo, Mn, Fe, Co and Ni, most preferably consisting of Fe, Ni and Co. These carbonyl compounds may also have a cyclopentadienyl group, alkyl group, hydrogen atom and the like. As examples of the carbonyl compound of a transition metal, there may be mentioned $M^1(CO)_6$ ($M^1$ represents V, Nb, Ta, Cr, Mo or W), $M^2{}_2(CO)_{10}$ ($M^2$ represents Mn, Tc or Re), $M^3(CO)_5$ ($M^3$ represents Fe, Ru or Os), $M^4{}_2(CO)_9$ ($M^4$ represents Fe, Ru or Os), $M^5{}_3(CO)_{12}$ ($M^5$ represents Fe, Ru or Os), $M^6{}_2(CO)_8$ ($M^6$ represents Co, Rh or Ir), $M^7{}_4(CO)_{12}$ ($M^7$ represents Co, Rh or Ir), $M^8(CO)_4$ ($M^8$ represents Ni, Pd or Pt), $Fe(CO)_4H_2$, cyclopentadienyltetracarbonyl vanadium, bis(cyclopentadienylcarbonyl) iron, bis(cyclopentadienylcarbonyl) nickel and the like. Of them, $Fe(CO)_5$, $Fe_2(CO)_9$ and $Ni(CO)_4$ especially give good results.

As the benzene transition metal compound, there may be mentioned, for example, dibenzene chromium, cyclopentadienylbenzene, chromium, dibenzene vanadium, dibenzene molybdenum, dibenzene tungsten and the like.

As the allyl compound of a transition metal, there may be mentioned, for example, di($\pi$-allyl) nickel, tri($\pi$-allyl) iron, tri($\pi$-allyl) cobalt and the like.

As the $\beta$-diketone and $\beta$-keto acid ester complexes of a transition metal, there may be mentioned $\beta$-diketone and $\beta$-keto acid ester complexes of a transition metal preferably selected from Ti, V, Cr, Mn, Fe, Co, Ni, Cu, Mo, Ru, Rh and Pd, especially from Fe, Co and Ni. As the $\beta$-diketone or $\beta$-keto acid ester complex of a transition metal, there may be mentioned, for example, acetylacetone, trifluoroacetylacetone, hexafluoroacetylacetone, dipivaloylmethane,pivaloyltrifluoroacetone, thenoyltrifluoroacetone, methyl acetoacetate, ethyl acetoacetate and the like. Of them, acetylacetone and alkyl acetoacetate are especially preferred.

As the carboxylic salt of a transition metal, there may be mentioned a carboxylic salt of a transition metal such as iron, nickel and cobalt, said carboxylic salt having 1 to 40 carbon atoms. As examples of the carboxylic salts, there may be mentioned formic, acetic, propionic, fumaric, maleic, oxalic, malonic, succinic, sebacic, citric, tartaric, lactic, oleic, capric, stearic, palmitic, lauric, montanic, naphthenic, 2-ethylhexanoic(octyl), benzoic, salicylic, phthalic, 4-cyclohexyl butyric, naphthalenecarboxylic, phenylacetic, acrylic, methacrylic, crotonic, linolic and linolenic salts of iron, nickel, cobalt or the like. Of them, carboxylic salts having no crystal water and having properties of easily dissolving in a hydrocarbon or properties of sublimation, for example, fumaric salts and higher carboxylic salts, are preferably employed.

As the thiocarboxylic salt of a transition metal, there may be mentioned, for example, thioacetic, thiopropionic, thiomaleic, thiofumaric, thiomalonic, thiostearic, thionaphthenic, thiobenzoic, thionaphthoic and thiobenzilic salts of iron, cobalt, nickel or the like. Of them, salts which are soluble or finely dispersible in a hydrocarbon compound, especially the former, are preferred.

As the metal in the alkoxides of a transition metal, there may be mentioned, for example, Fe, Mn, Mo, Cr, V, Zr and the like. Of them, Fe is most preferred. As the alcohol and phenol components in the alkoxides of a transition metal, there may be mentioned alcohols and phenols having 20 or less carbon atoms, such as methanol, ethanol, propanol, butanol, pentanol, hexanol, cyclohexanol, phenol, cresol, catechol, resorcinol, guaiacol, pyrogallol, naphthol and salicylaldehyde. Of such alkoxides, iron methoxide, iron ethoxide, iron phenoxide and iron salicylaldehyde are preferred. As the thioalcohol and thiophenol components in the thioalkoxides and thiophenoxides of a transition metal, there may be mentioned, for example, thiomethanol, thioethanol, thiopropanol, thiophenol and thiobenzylalcohol. Of such thioalkoxides and thiophenoxides, iron thioalkoxides and iron thiophenoxides, especially those which are soluble in a hydrocarbon compound, are preferred.

According to the present invention, a liquid reaction product obtained by the reaction between a halogenated transition metal compound and cyclopentadiene in the presence of a basic substance may be added as an organic transition metal compound to the heating zone as it is or after removal of the organic solvent.

As the transition metals to be halogenated, there may be preferably employed metals belonging to the Group IVb of the Periodic Table (especially Ti), the Group Vb (especially V), the Group VIb (especially Cr, Mo and W), the Group VIIb (especially Mn), the Group VIII (especially Fe, Co, Ni, Ru, Rh, Os and Ir). Of them, Fe, Co and Ni are most preferred. As the halogen, chlorine or bromine is preferably employed. As preferred examples of the halogenated transition metals, there may be mentioned $FeCl_2$, $FeBr_2$, $FeCl_3$, $FeBr_3$, $FeI_2$, $NiCl_2$, $CoCl_2$, $CoBr_2$, $CoI_2$, $VCl_3$, $VCl_4$, $TiCl_3$, $TiCl_4$, $CrCl_2$, $CrCl_3$, $MnCl_2$, $MnCl_3$, $RuCl_3$, $RhCl_3$, $MoCl_3$, $MoCl_4$, $MoCl_5$, $IrCl_3$, $WCl_5$, $WCl_6$, $OsCl_3$, $OsCl_4$and the like, more preferably $FeCl_2$, $FeCl_3$, $FeBr_2$, $FeBr_3$, $NiCl_2$ and $CoCl_2$.

Cyclopentadiene to be reacted with the halogenated transition metal may be produced according to the known methods, for example, thermal cracking of dicyclopentadiene.

The amount ratio of cyclopentadiene to the halogenated transition metal may be determined according to the kind of the metal of the halogenated transition metal compound. From the viewpoint of suppressing the evolution of soot, the molar ratio of cyclopentadiene to the halogenated transition metal is 2.0 or more, preferably 2.1 or more.

As the basic substance, there may be employed sodium or organic bases, preferably amino compounds, more preferably strongly basic secondary amino compounds. As examples of such secondary amino compounds, there may be mentioned diethylamine, dimethylamine, dibutylamine, dibenzylamine, dihexylamine and the like.

The amount of the basic substance to be added for the reaction between the halogenated transition metal and cyclopentadiene may be determined according to the valence of the metal of the halogenated transition metal compound. The basic substance may be added in an amount of a mole number or gram-atom number equal to or more than the valence of the metal. If $FeCl_2$ is used as the halogenated transition metal compound, 2 moles or more of amine or 2 gram-atoms or more of sodium may be added since the valence of the Fe is 2. Preferably, 1 to 1.1 gram-atoms of sodium or 2 to 4 moles of amine may be added per valence 1 of the transition metal.

The reaction between the halogenated transition metal compound and cyclopentadiene may be carried out in an appropriate medium system. As a solvent for the medium, an aromatic, aliphatic or alicyclic hydrocarbon having 5 to 15 carbon atoms may preferably be used. As examples of such hydrocarbon, there may be mentioned benzene, toluene, xylene, petroleum ether, pentane, hexane, cyclohexane, heptane, octane, decane, cyclooctane, decaline, cyclopentane and the like. For the medium, various ethers may also be used, for example, diethyl ether, tetrahydrofuran, dioxane, dialkyl ether obtained from ethylene glycol or diethylene glycol and the like. To such medium, polycyclic aromatic hydrocarbons such as naphthalene, anthracene, phenanthrene, biphenyl, stilbene and the like are preferably added in some cases. The amount of such organic solvents for the medium may be determined from a viewpoint of improving the operation of the reaction. In the case where ether is used as the solvent, the amount thereof relative to the weight of the raw hydrocarbons is preferably 20% or less.

Such organic solvents may improve the homogeneous dispersion of the halogenated transition metal compound in the system containing a raw hydrocarbon and cyclopentadiene, and may serve also as a raw material for producing a carbon filament.

In the present invention, the reaction between the halogenated transition metal compound and cyclopentadiene may ordinarily be carried out through the following steps:

(I) The halogenated transition metal compound is allowed to disperse in the solvent. For the solvent, an amine which is a basic substance may be used in excess together with those mentioned above;

(II) (i) Cyclopentadiene and sodium are allowed to react in another solvent, then the resultant mixture is mixed with the dispersion obtained in (I) above and heated to preferably 40° to 100° C. to carry out the reaction. (ii), Alternatively, cyclopentadiene is directly added to the dispersion obtained in (I) together with amine to effect the reaction at a temperature of from 20° to 80° C. preferably from 30° to 60° C. (Of the above (i) and (ii), (ii) may be employed in case where the transition metal is Fe or Ni. It is generally preferred to employ (i).)

The reaction product obtained in (II) may be filtered, and the filtrate may be introduced into the heating zone. In case where an amine is contained in the filtrate, the amine may be removed from the filtrate by evaporation (there is no need for completely removing the amine). A solvent may be added to the filtrate according to need, and the thus treated filtrate may be introduced into the heating zone.

In the present invention, the methods of supplying the organic transition metal compound or the transition metal salt or complex and the raw material hydrocarbon to the heating zone are not critical. Any method may be employed in which the organic transition metal compound or the transition metal salt or complex and the raw material hydrocarbon are introduced into the heating zone in the form of a gas or minute particles. When the organic transition metal compound or the transition metal salt or complex and the raw material hydrocarbon are introduced into the heating zone in the form of a mixture, it is extremely important that they are introduced in the form of a homogeneous mixture. The term "homogeneous mixture" as used herein is intended to mean a mixture in which all of the organic transition metal compound or the transition metal salt or complex is dispersed into molecules or minute particles in the raw material hydrocarbon.

Examples of the methods of supplying the organic transition metal compound and the raw material hydrocarbon will now be detailed below. In the case where the transition metal salt or complex is employed in place of the organic transition metal compound, substantially the same methods may be utilized.

The solid organic transition metal compound (for example, cyclopentadienyl compound) and the solid raw material hydrocarbon (for example, anthracene and naphthalene) may be introduced into the heating zone by: (1) pulverizing the solid transition metal compound and the solid raw material hydrocarbon, and supplying separately or in the form of a mixture thereof to the heating zone kept at a temperature enough for pyrolysis by means of an appropriate powder feeding device; or (2) heating the solid raw material hydrocarbon to effect gasification thereof while pulverizing the solid organic transition metal compound to form powders to be carried by a powder feeding device, and then preparing a homogeneous mixture of the resultant gas and the powders, followed by supplying of the mixture to the heating zone by means of a carrier gas.

The solid organic transition metal compound (for example, those mentioned above) and the liquid raw material hydrocarbon (for example, pentane and benzene) may be introduced into the heating zone by: (3) dissolving or finely dispersing the solid compound in the liquid raw material hydrocarbon, and spraying or injecting the resultant solution or dispersion into the heating zone through an appropriate nozzle; (4) dissolving the solid compound in the liquid raw material hydrocarbon, vaporizing the solution by means of an appropriate vaporizer, and supplying the resulting gas to the heating zone by means of a carrier gas; or (5) spraying or injecting the liquid raw material hydrocarbon into the heating zone through a nozzle or supplying the vaporized hydrocarbon to the heating zone by menas of a carrier gas, while supplying the pulverized solid compound to the heating zone with a temperature enough for the pyrolysis by means of a powder feeding device or supplying the vaporized or sublimated compound by means of a carrier gas.

The solid organic transition metal compound (for example, those mentioned above) and the gaseous raw material hydrocarbon (for example, methane and acetylene) may be introduced into the heating zone by: (6) pulverizing the solid compound and supplying the compound to the heating zone with a temperature enough for the pyrolysis of the compound by means of a powder feeding device, while supplying the gaseous raw material hydrocarbon through another line; or (7a) vaporizing or sublimating the solid compound by means of a vaporizer or the like and supplying the gas to the heating zone by means of a carrier gas or in the form of a mixture with the raw material hydrocarbon, while supplying the gaseous raw material hydrocarbon in the form of a mixture with the vaporized compound as mentioned above or through another line, or (7b) a method comprising a combination of the above-mentioned methods (1), (2), (3) and (5), for example, dissolving the solid organic transition metal compound in a liquid hydrocarbon compound and spraying the resultant solution into the heating zone while separately supplying the gaseous hydrocarbon compound to the heating zone.

Of the above methods (1) to (7b), methods (3) and (7b) are preferred.

The liquid organic transition metal compound (for example, the carbonyl compound and the reaction product obtained by the reaction between a halogenated transition metal compound and cyclopentadiene in the presence of a basic substance) and the solid raw material hydrocarbon (for example, those mentioned above) may be introduced into the heating zone by: (8) pulverizing the solid raw material hydrocarbon and supplying it to the heating zone with a temperature enough for the sublimation by means of a powder feeding device, or vaporizing the raw material hydrocarbon using an appropriate vaporizer and supplying the resulting gas by means of a carrier gas, while spraying or injecting the liquid compound into the heating zone through a nozzle, or vaporizing the liquid compound by means of an appropriate vaporizer and supplying the resulting gas by means of a carrier gas, separately from or together with the vaporized raw material hydrocarbon.

The liquid organic transition metal compound (for example, those mentioned above) and the liquid raw material hydrocarbon (for example, those mentioned above) may be introduced into the heating zone by: (9)

mixing the liquid compound and the liquid raw material hydrocarbon, and spraying or injecting the resultant mixture into the heating zone through an appropriate nozzle; (10) mixing the liquid compound and the liquid raw material hydrocarbon, vaporizing the mixture by means of a vaporizer, and supplying the resultant gas to the heating zone by means of a carrier gas; (11) spraying or injecting the liquid compound and the liquid raw material hydrocarbon separately into the heating zone through separate nozzles; or (12) vaporizing the liquid compound and the liquid raw material hydrocarbon and supplying them separately to the heating zone by means of a carrier gas.

The liquid organic transition metal compound (for example, those mentioned above) and the gaseous raw material hydrocarbon (for example, those mentioned above) may be introduced into the heating zone by: (13) spraying or injecting the liquid compound to the heating zone through a nozzle, while supplying the gaseous raw material hydrocarbon through another line; or (14) vaporizing the liquid compound by means of a vaporizer, and supplying the resultant gas to the heating zone by means of a carrier gas or in the form of a mixture with the gaseous raw material hydrocarbon, while supplying the gaseous raw material hydrocarbon in the mixture with the vaporized compound as mentioned just above or through another line.

In the present invention, the pipes for introducing the raw material hydrocarbon and the organic transition metal compound may be lagged or partially cooled using jackets.

Introduction of the raw material hydrocarbon and the organic transition metal compound may be effected either continuously or intermittently. However, continuous introduction contributes to obtaining uniform carbon filaments.

The form of the nozzles of the pipes for introducing the raw material hydrocarbon and organic transition metal compound in the form of liquids is not critical. In order to accelerate the production of the carbon filaments, a trumpet-shaped nozzle or a porous one through which the liquid is oozed into the heating zone may also be used. Or to the porous nozzle, the liquid and a gas such as hydrogen may be supplied simultaneously through separate pipes to spray the liquid in a form of minute particles into the heating zone.

Moreover, it is preferred to employ a nozzle having plural openings. Further, plural pipes each having one opening may also be employed. The diameters of such nozzles are preferably in the range of from 0.01 to 10 mm.

The carbon filament of the present invention can be easily converted upon heating to a graphite filament. For the conversion into the graphite filament, heat treatment may be effected at a temperature more than 2000° C., preferably 2400° C. for 1 to 60 minutes, preferably 5 to 30 minutes, more preferably 5 to 20 minutes in an inert gas, especially argon gas. By such a heat treatment, planar hexagonal carbon network layers in the graphite filament (002) are stacked at interlayer spacing ($d_{002}$) of 0.345 nm or less as measured according to powder X-ray diffractometry and the crystallite size in the graphite filament (Lc) becomes 15 nm or more. Preferably, by a heat treatment at 2700° C. or more for 20 minutes, the $d_{002}$ and Lc become 0.337 nm or less and 15 nm or more, respectively.

The heat treatment may be conducted in the following manner. Carbon filaments may be collected and packed into a vessel such as crucible. The vessel may be set in the core tube of a graphitizing furnace having graphite electrodes, then the atmosphere is replaced by an inert gas, followed by heating. According to need, heating to 2000° C. may be carried out under vacuum. As the inert gas, argon gas, nitrogen gas and the like are preferably employed.

The heating of the carbon filaments may be conducted by applying electric current directly to the mass of carbon filaments or it may also be conducted using high-frequency heating, electric-arc heating, plasma flame, laser and the like.

Figure 6:
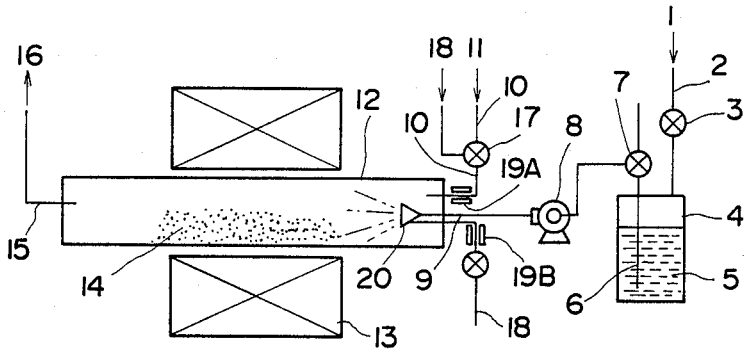
FIG. 6 is a diagrammatic view of yet still a further form of an apparatus used for producing a carbon filament of the present invention.

A method of producing the carbon filaments according to the present invention is now explained with reference to FIG. 6. As shown in FIG. 6, a suitable apparatus consists of a tubular electric furnace 13; a furnace core tube 12 transversely mounted inside the tubular electric furnace; a raw material-introducing pipe 9 and raw material-discharge pipe 15 respectively inserted through the ends of the furnace core tube; a conduit 10 for introducing an inert gas or the like; a tank 4 for storing a liquid raw material; a supply system for feeding the raw material from the tank 4, through a conduit 6, a valve 7, a constant delivery pump 8 and a conduit 9, to a nozzle 20; a conduit 2 and valve 3 for introducing an inert gas 1 into the tank 4; and a valve 17 and conduit 10 for introducing an inert gas 11 and/or a gas 18 into the furnance core tube 12. Conduits 10 and 18 are provided with heaters 19A and 19B, respectively. In this apparatus, the inert gas 11 such as nitrogen gas is introduced through the conduit 10 into the furnace core tube 12 thereby to sufficiently replace the air in the core tube by the inert gas. Then, the valve 17 is switched to introduce the preheated gas 18, followed by temperature elevation of the electric furnace. The discharge gas 16 is discharged through the pipe 15 disposed at one end of the furnace core tube 12. When the inside temperature of the furnace core tube has reached a predetermined level, supply of the liquid raw material 5 is started. Illustratively stated, the valve 3 is opened. As a result, the inert gas 1 is allowed to flow through the conduit 2 into the tank 4 to apply a pressure on the liquid raw material. Due to the pressure, the liquid raw material 5 is supplied from the tank, through the conduit 6, valve 7, constant delivery pump 8 and conduit 9, to the reaction zone of the furnace core tube 12. The raw material is carbonized and converted to carbon filaments 14 by the catalytic action of the metal compound. The carbon filaments, once formed, immediately fall or gradually fall while floating with the supplied gas to form a pile of carbon filaments in the furnace core tube. The resulting pile of carbon filaments may be collected in a continuous manner or on a batch basis. The collecting method is not critical. For example, a preferred mode of the method is one in which a plate is installed in the reaction zone and the plate having carbon filaments thereon is pushed out of the reaction zone continuously or intermittently.

In such apparatus, the furnace core tube may be installed vertically, horizontally or with a steep gradient.

As a material for the furnace core tube, ceramics such as alumina, mullite, graphite and the like are preferred.

In the furnace core tube, an appropriate heat-resisting sheet, net, vessel or the like may be placed in order to facilitate the taking out of the produced carbon filaments.

In the production using such electric furnace in which heating sources are installed outside the reaction tube, increases in the diameter of the reaction vessel and in the amount of the raw material hydrocarbon cause a decrease in the yield of the carbon filaments. This may be probably because heat supply becomes insufficient or the catalytic activity is lowered. In order to maintain a sufficient catalytic activity, addition of a filament-forming auxiliary or a oxidizing gas may be preferred.

The amount of the organic transition metal compound or the transition metal salt or complex relative to the weight of the hydrocarbon compound or derivative thereof, which is varied according to the kind of the organic transition metal compound or the transition metal salt or complex, is generally in the range of $10^{-3}$ to 20%, preferably 0.01 to 10%, more preferably 0.1 to 5%. In introducing the metal compound or the salt or complex and the hydrocarbon or derivative thereof into the heating zone, in order to increase the yield of the filament of the present invention, it is preferred that the organic transition metal compound or the transition metal salt or complex be in the form of a homogeneous mixture with the hydrocarbon or derivative thereof. The homogeneous mixture may be a mixture of the organic transition metal compound or the transition metal salt or complex with part or all of the hydrocarbon or derivative thereof in either form of a gas or a liquid, and may be prepared preferably at 400° C. or less before introducing into the heating zone.

The reaction temperature in the heating zone may be varied according to the kind of the organic transition metal compound or the transition metal salt or complex.

In general, the temperature in the heating zone is 400° to 3000° C., preferably 800° to 1800° C., more preferably 900° to 1600° C., further preferably 1000° to 1500° C. Carbon filaments may be produced in a gas stream in the heating zone. The carbon filaments produced in the heating zone may fall down and be piled up, and then taken out after cooling of the oven. When a vertical type oven equipped with a hopper at the bottom thereof, the carbon filament produced in the oven can be continuously taken out of the oven through the hopper.

When a horizontal type oven is used, filaments produced in a gas may fall down and be piled up while intertwining thereby to form a mass form of the carbon filament.

The hydrocarbon or derivative thereof may be heated in the heating zone for a period of from $10^{-2}$ to 1000 sec, preferably $5\times10^{-2}$ to 500 sec. If the period for heating is less than $10^{-2}$ sec, the yield of the filament is remarkably decreased. If the period for heating is more than 1000 sec, apparatus difficulties may be raised. The heating of the hydrocarbon or derivative thereof in the heating zone may be effected under a pressure of from $10^{-3}$ to 5 atm, preferably $10^{-2}$ to 2 atm, more preferably from 1.1 to 2 atm. If the pressure is less than $10^{-3}$, the yield of the filament may be decreased. If the pressure is more than 5 atm, apparatus difficulties may be raised. In effecting the reaction under pressure, the production of undesired secondary gases may be eliminated. Filaments may be produced under reduced pressure. However, from the viewpoint of efficient production, it is preferred that filament formation be effected under superatmospheric pressure.

The diameter of the filament and the ratio of filament length to filament diameter of the filament may be controlled by changing the ratio of amount of hydrocarbon compound to amount of organic transition metal compound or transition metal salt or complex, the preset temperature of a mixture containing the hydrocarbon or derivative thereof and the metal compound or the salt or complex, the dwell time of the gas at a preset temperature range, the hydrocarbon material concentration in the gas, etc.

The crimping degree of the carbon filament varies according to a flow rate of the gas. The lower the flow rate of the gas, the larger the crimping degree, and the higher the flow rate of the gas, the smaller the crimping degree. The crimping degree of the filament may become small when a combination of a silicon compound as a filament-forming anxiliary, an organic transition metal compound and nitrogen gas is used.

The hydrocarbons and derivatives thereof (hereinafter often referred to simply as "hydrocarbon compounds") to be used in the present invention are compounds composed mainly of carbon atoms and hydrogen atoms. Such a compound may be applied to a heating zone in either form of a gas, solid and a liquid, preferably in a minute form, for example, in the form of a mist, a sublimate or a gas. As such a compound, there may be employed hydrocarbon compounds preferably having not more than 20 carbon atoms, more preferably having not more than 14 carbon atoms from the standpoint of easiness in handling. As suitable examples of the hydrocarbon compounds, there may be mentioned methane, ethane, ethylene, acetylene, propane, propylene, butane, butene, butadiene, pentane, pentene, cyclopentadiene, hexane, cyclohexane, benzene, toluene, xylene, styrene, naphthalene, anthracene, etc. The above-mentioned compounds may be employed either alone or in combination. From the standpoint of economy, it is preferred to use mixtures of fractions of coal tar, such as anthracene, phenanthrene, chrysene, fluoranthene, pyrene, etc., which are by-products obtained by pyrolysis of fuel oil. The above-mentioned compounds include derivatives of hydrocarbon containing a nitrogen atom, sulfur atom, phosphorus atom, oxygen atom and/or halogen atom.

The organic transition metal compound or the transition metal salt or complex, as mentioned before, is used as a catalyst for producing the carbon filament of the present invention. The amount of an organic transition metal compound or transition metal salt or complex to be used in the process of the present invention relative to the weight of the hydrocarbon compound may be, as mentioned before, generally in the range of $10^{-3}$ to 20%, preferably 0.01 to 10%, more preferably 0.1 to 5%. When it is necessary to incorporate metals in a large amount into a filament, the amount of the metal compound or the salt or complex relative to the weight of the hydrocarbon compound may be more than 20%. In general, it is sufficient that the amount of the metal compound or the salt or complex relative to the weight of the member is 20% or less. When the amount of the metal compound or the salt or complex is less than $10^{-3}$% by weight, there is a disadvantage that it is difficult to form a filament and that an undesired particulate matter is formed in an increased amount.

When a carbonyl compound of a transition metal is used as an organic transition metal compound, the amount of the carbonyl compound of a transition metal relative to the total weight of a mixture of the carbonyl compound of a transition metal and the hydrocarbon compound may be in the range of $10^{-2}$ to 10%, preferably 0.05 to 8%, more preferably 0.1 to 4%. In this case, each of the amount of a carrier and the amount of a hydrocarbon compound may be in the range of $10^{-4}$ to $10^2$ parts by weight, preferably $10^{-3}$ to 10 parts by weight per part by weight of the above-mentioned mixture. The carbonyl compound of a transition metal may be introduced into the heating zone of a temperature of 800° to 1600° C. in the form of a homogeneous solution thereof in a part or all of the above-mentioned hydrocarbon compound at a rate of $10^{-3}$ to 10 g/min, preferably 0.005 to 5 g/min, more preferably 0.01 to 1 g/min per square centimeter of the minimum sectional area of the heating zone. When the rate is outside the above-mentioned range, the formation of undesired particulate matter may be increased.

When a β-diketone complex of a transition metal is used as a catalyst, the amount of the β-diketone complex of a transition metal relative to the total weight of a mixture of the complex and the hydrocarbon compound, which is varied according to the solubility of the complex in the hydrocarbon compound, may be in the range of $10^{-2}$ to 30%, preferably 0.03 to 8%, more preferably 0.05 to 4%. The homegeneous solution of the complex and the hydrocarbon compound may be introduced into the heating zone at a rate of about $10^{-3}$ to 10 g/min, preferably about 0.005 to 5 g/min per square centimeter of the minimum sectional area of the heating zone. In this case, hydrogen gas may be used as a carrier.

When a transition metal salt of a carboxilic acid is used as a catalyst, the amount of the transition metal salt relative to the total weight of a mixture of the hydrocarbon compound and the metal salt may be 0.01% or more, preferably 0.03 to 15%, more preferably 0.05 to 8%. When the amount of the transition metal salt is less than 0.01%, the yield of the filament is decreased. The transition metal salt of a carboxilic acid may be introduced into a heating zone separately from the hydrocarbon compound or in the form of a homogeneous solution or mixture with part or all of the hydrocarbon compound. As a carrier, hydrogen gas or an inert gas may be employed.

Prior to supplying the hydrocarbon compound and the organic transition metal compound or the transition metal salt or complex into the heating zone, the hydrocarbon compound and the organic transition metal compound or the transition metal salt or complex may be subjected to pre-heating. The temperature for pre-heating, which varies according to the kind of the hydrocarbon compound and the organic transition metal compound or the transition metal salt or complex, may be generally 1500° C. or less, preferably 1300° C. or less, more preferably 100° to 500° C. If the temperature is too low, it is disadvantageous that the hydrocarbon compound may not be kept in the form of a gas and the metal compound or the salt or complex may not be activated. If the temperature is more than 1500° C., disadvantageously, the hydrocarbon compound may be carbonized to form a particulate matter and clogging may occur, causing the yield of the filament to be decreased. In effecting the pre-heating, the mixture of the hydrocarbon compound and the organic transition metal compound or the transition metal salt or complex may be heated at the above-mentioned temperature range. Alternatively, each of the hydrocarbon compound and the organic transition metal compound or the transition metal salt or complex may be introduced into a zone for pre-heating and mixed while pre-heating. Further, the organic transition metal compound or the transition metal salt or complex may be introduced into the zone for pre-heating in the form of a homogeneous solution thereof with part or all of the hydrocarbon compound, in the former case mixed with the remaining hydrocarbon compound, by means of a carrier gas, followed by pre-heating. The homogeneous mixture may be prepared at a temperature of 400° C. or less, mixed with the remaining hydrocarbon compound, and entrained by a carrier gas which has been heated at a temperature of 100° to 500° C.

Then, the mixture of the hydrocarbon compound and the organic transition metal compound or the transition metal salt or complex may be supplied to a heating zone in either form of a gas or a liquid. The temperature of the heating zone, which varies according to the kind of the hydrocarbon compound and the organic transition metal compound or the transition metal salt or complex, may be generally in the range of 400° to 3000° C., preferably 800° to 1800° C., more preferably 900° to 1600° C., most preferably 1000° to 1500° C. If the temperature in the heating zone is less than 400° C., it is disadvantageous that the reaction cannot be effected sufficiently. If the temperature in the heating zone is more than 3000° C., it is disadvantageous that the violent degradation of the filament produced may occur. That is, when the temperature in the heating zone is outside the above-mentioned range, the yield of the filament is decreased.

When a carbonyl compound of a transition metal is used as the organic transition metal compound, it is preferred that a carbonyl compound of a transition metal be pre-heated at 150° to 400° C., preferably 200° to 400° C., more preferably 250° to 400° C. in the form of a homogeneous mixture with part or all of the hydrocarbon compound. In effecting the pre-heating, the homogeneous mixture may be diluted with the hydrocarbon compound and/or a carrier gas so that the concentration of the carbonyl compound of a transition metal in the resulting mixture is 20% by weight or less, preferably 10% by weight or less. As the hydrocarbon compound when the carbonyl compound of a transition metal is used, there may be preferably employed, for example, ethylene, acetylene, etc. The pre-heated mixture may then be introduced into a heating zone of a temperature of about 800° to 1600° C. It is preferred that the pre-heated mixture be introduced into a heating zone as promptly as possible. In order to introduce the mixture into the heating zone as promptly as possible, the hydrocarbon compound and the carrier gas for diluting the homogeneous mixture of the metal compound or the salt or complex and the hydrocarbon compound may be preferably preheated at 100° to 500° C. before any contact thereof with the homogeneous mixture.

When a β-diketone complex of a transition metal is used as the catalyst, the β-diketone complex of a transition metal may be pre-heated at 150° to 400° C., preferably 200° to 400° C. in the presence of hydrogen gas, and then, introduced into a heating zone kept at 800° to 1800° C., preferably 1000° to 1600° C. as promptly as possible. For this purpose, the hydrocarbon compound and the carrier gas may also be pre-heated.

The zone for pre-heating and the heating zone are heated by customary methods using, for example, an electric oven, an infrared heater, a laser heater and a microwave heater.

In the method of the present invention, as mentioned before, a carrier may be used for introducing the mixture into a heating zone, controlling the concentration of the hydrocarbon compound in the heating zone, and transferring the filaments produced in the heating zone.

As such a carrier, there may be mentioned inert gases such as helium gas, argon gas, xenon gas and nitrogen gas, reducing gases such as hydrogen gas, and mixtures thereof. Of them, there may be preferably employed hydrogen gas, argon gas nitrogen gas, a mixture of argon gas and hydrogen gas and a mixture of a nitrogen gas and a hydrogen gas.

In producing the filament of the present invention on a large scale according to the above-mentioned method, a soot-like by-product is apt to occur which causes the yield of the filament to be decreased. In order to eliminate the production of soot-like by-product in the reaction system, the carrier gas may contain an oxidizing gas which is capable of promoting dehydrogenation of the hydrocarbon compound. As such an oxidizing gas, there may be mentioned, for example, carbon dioxide gas, steam, oxygen gas and the like. The amount of the oxidizing gas in the mixture in the heating zone may be 0.05 to 10% by weight, preferably 0.1 to 5% by weight, more preferably 0.1 to 1% by weight based on the total of the mixture in the heating zone.

In order to increase the yield of the filament of the present invention, the reaction of the mixture in the heating zone may be effected advantageously in the presence of a filament-forming auxiliary which is capable of promoting dehydrogenation of the hydrocarbon compound. As the filament-forming auxiliary, there may be mentioned, for example, sulfur and sulfur compounds including sulfur oxide, sulfur halide, hydrogen sulfide and compounds relating thereto such as polyhydrogen sulfide, mercaptan and thioether, boron compounds such as boron sulfide, nitrogen compounds such as nitrogen sulfide, carbon disulfide and compounds related thereto such as thiocarbonate, and thiocyanic acid and compounds related thereto such as thiocyanate and thiocyanic ester; silicon and silicon compounds including hydrogen compounds such as monosilane and disilane, oxides such as silicon dioxide, siloxiane and siloxene, halides such as tetrachlorosilane, boron compounds, carbide, nitride, and derivatives thereof including halogeno-, alkyl- and aryl-substituted compounds; and phosphorus and phosphorus compounds including oxides such as $P_4O_6$, $(PO_2)n$ and $(P_2O_5)n$, acids such as $HPH_2O_2$ and $H_2PHO_3$, phoshates such as $MPH_2O_2$ and $M_3PO_4$ (wherein M stands for a metal atom), phosphorus hydride, sulfides such as $P_4S$, iron compounds such as $Fe_3P$, alkyl or aryl phosphines represented by $RPH_2$ (wherein R stands for an alkyl or an aryl group), dialkyl or diaryl phosphines represented by $R_2PH$ (wherein R is as defined above), trialkyl or triaryl phosphines represented by $R_3P$ (wherein R is as defined above), methyl- or phenylphosphonate represented by $R'PO_2H_2$ (wherein R' is methyl or phenyl group), dimethyl- or diphenylphosphonate represented by $R'_2PO_2H$ (wherein R' is as defined above), phosphites represented by $ROPO_2H_2$ (wherein R is as defined above), and phosphates represented by $ROPO_3H$ (wherein R is as defined above). Of them, there may be preferably employed hydrogen sulfide, thiophene, thioethers, hydrogen compounds of silane such as monosilane and disilane, alkyl- or aryl-substituted organic silicon compounds, triphenylphosphine, trimethylphosphine, etc. The filament-forming auxiliary may be supplied into the heating zone in the form of a mixture with a carrier gas or in the form of a mixture with a hydrocarbon compound. The amount of the filament-forming auxiliary is varied according to the kind of filament-forming auxiliary and the organic transition metal compound or the transition metal salt or complex introduced into a heating zone. In general, the amount of the filament-forming auxiliary may be 0.01 to 10% by weight based on the weight of the hydrocarbon compound. When sulfur and sulfur compounds are used as a filament-forming auxiliary and organic transition metal compounds containing Fe, Ni or Co are used as a catalyst, the amount of the filament-forming auxiliary may be preferably 0.01 to 5% by weight, more preferably 0.01 to 1% by weight based on the weight of the hydrocarbon compound in the heating zone. When silicon and silicon compounds are used as a filament-forming auxiliary, the amount of the filament-forming auxiliary may be preferably 30% by weight or less, more preferably 10% by weight or less based on the weight of the metal contained in the catalyst in the heating zone. When phosphorus and phosphorus compounds are used as a filament-forming auxiliary, the amount of the filament-forming auxiliary may be preferably 0.1 to 5% by weight based on the weight of the hydrocarbon compound in the heating zone.

The carbon filament of the present invention thus produced has a relatively large surface area per unit weight and an excellent chemical reactivity, and is easily oxidized and graphitized. The novel graphite filament produced from the carbon filament of the present invention by graphitization is, as mentioned before, included in the present invention. The carbon filament and graphite filament of the present invention have a relatively small diameter and a relatively large aspect ratio and are excellent in electrical and thermal conductivity. Especially, the graphite filament of the present invention is remarkably excellent in electrical and thermal conductivity. Therefore, the carbon filament or the graphite filament of the present invention may be incorporated in resins, rubbers, paints, adhesives, ceramics and the like to provide excellent electrically-conductive and thermally-conductive materials. Such materials may be used not only in electronical application field but also as materials for heat dissipation.

The carbon filament or the graphite filament of the present invention, especially having a crimp, may be easily reduced to powder and processed to form a material having a uniform shape. Further, the powdered material of the filament of the present invention may be processed using a bonding agent to form uniform material having a high bulk density and exhibiting an improved bite into an extruder. The carbon filament or the graphite filament of the present invention may also be processed by means of a paper machine etc. to easily form a sheet which can be advantageously used as an electrode, a filter, a diaphragm for sound facilities, etc. When the carbon filament or the graphite filament is used as an active material of a primary battery and a secondary battery, the batteries exhibit excellent discharge properties. Further, the filament of the present invention may be incorporated in a resin to form a material having excellent slide characteristics. Moreover, the filament of the present invention has a large specific surface area and, therefore, the filament of the present invention may be activated to form a fibrous activated carbon which is excellent in adsorptivity.

As is apparent from the foregoing, according to the present invention, a carbon filament having a diameter, which is uniform lengthwise, of from 0.01 to 15 μm, a length of from 20 μm to 20 mm and a ratio of filament length to filament diameter of 20 or more, especially 1000 to 5000 can be efficiently produced in high yield by a process in which a specific species of catalysts are employed, preferably in combination with a filament-forming auxiliary, in specific amount proportions. The process is suited for production of a carbon filament on a commercial scale. According to need, the filament may be crimped to an appropriate degree. The carbon filament can be readily graphitized by heat treatment to give a graphite filament. The carbon filament and graphite filament are useful as filling materials for plastics, rubbers, paints, adhesives, ceramics, carbons and metals. They are also useful as an electrode material, electromagnetic wave shield, etc.

PREFERRED EMBODIMENTS

The present invention will be illustrated in more detail with reference to the following Examples, which should not be construed to be limiting in scope of the present invention.

EXAMPLE 1

The apparatus diagrammatically shown in FIG. 1 was used. In FIG. 1, numeral 1 designates a carrier gas supply source, numerals 2 and 3 flow meters, numeral 4 a raw material hydrocarbon supply source, numeral 5 a constant delivery pump, numeral 6 a raw material hydrocarbon vaporizer, numeral 7 a reaction vessel, numeral 8 a heater, numeral 9 a gas temperature sensing head, numeral 11 a gas outlet and numerals 12 to 14 and 16 valves. In this Example, a tubular electric furnace was used as the heater 8 and a quartz tube having a diameter of 90 mm was used as the reaction vessel 7.

First, the entire apparatus was flushed with a hydrogen stream, and heating of the apparatus was initiated. A mixed material obtained by dissolving 0.15 g (0.03%) of ferrocene in 500 g of benzene was charged into a heated vaporizer 6 by means of a constant delivery pump 5. After the vaporization in the vaporizer, the mixed material was entrained into a reaction vessel 7 by a hydrogen stream as a carrier gas. The flow rate of the carrier gas, delivery rate of benzene and gas temperature in the heating zone were controlled at 1,000 ml/min, about 0.4 ml/min and 1000° C., respectively. A carbon filament product was taken out after heating had been stopped and the reaction tube had been cooled completely. The product was mainly observed in an area around the portion (C) of the reaction tube 7. The diameters of the carbon filament distributed in the range of from 2 to 7 μm, especially from 3 to 5 μm. The lengths of the filament distributed in the range of from 3 to 20 mm, especially from 5 to 10 mm. Filaments having 2 to 3 crimps and a crimping degree of 9.6% were found among the obtained filaments.

EXAMPLE 2

Figure 2:
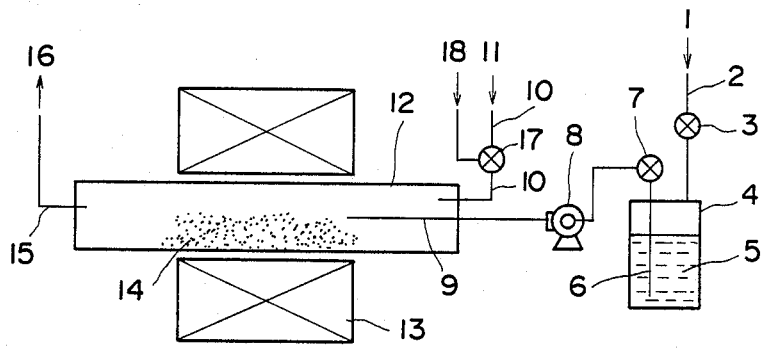
FIG. 2 is a diagrammatic view of another form of an apparatus used for producing a carbon filament of the present invention.
Figure 3:
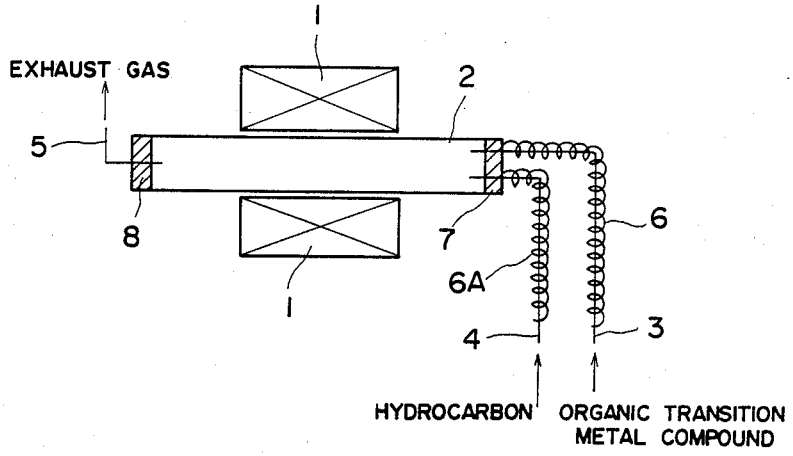
FIG. 3 is a diagrammatic view of a further form of an apparatus used for producing a carbon filament of the present invention.

The apparatus diagrammatically shown in FIG. 2 was used. In FIG. 2, numeral 1 designates an inert gas, numerals 2, 6 and 10 conduits, numerals 3, 7 and 17 valves, numeral 4 a tank, numeral 5 a raw material liquid, numeral 8 a constant delivery pump, numeral 9 a raw material-introducing pipe, numeral 11 an inert gas, numeral 12 a furnace core tube, numeral 13 an electric furnace, numeral 14 filaments, numeral 15 a raw material-discharge pipe, numeral 16 an exhaust gas and numeral 18 a gas. An alumina furnace core tube 12 having an inside diameter of 60 mm was transversely mounted inside a tubular electric furnace 13 having a heater as shown in FIG. 2, and both ends of the core tube were sealed with rubber stoppers. A material-introducing alumina pipe having an inside diameter of 6 mm was passed through one of the stoppers, and one end of the pipe was so arranged that the outlet came to the center portion of the furnace tube at a position having a furnace inside temperature of 510° C. as measured previously. The other end was placed outside the furnace and connected to a constant delivery pump 8 by the use of a rubber tube. Bis(cyclopentadienyl) iron was dissolved in benzene to obtain a material solution having a concentration of 0.2% by weight. Into the constant delivery pump was fed the material solution which was pressured with an inert gas as shown in FIG. 2. Through the rubber stopper on the material-introducing side was also pierced a pipe having the same diameter, through which an inert gas to be used for the replacement of the atmosphere inside the furnace and hydrogen gas for aid of filament growth were introduced through the medium of a rubber tube. On the other hand, the rubber stopper of the other end had an alumina pipe having an inside diameter of 6 mm inserted thereinto so that an exhaust gas could be discharged.

First of all, the inside of the furnace was subjected to replacement with an inert gas. Switching for hydrogen gas was made, and the temperature was elevated so as to achieve 1200° C. around the center of the furnace. At the outlet of the pipe 9, the temperature was 500° C. The material solution was fed at a rate of 1 cc/min for 15 minutes while introducing hydrogen gas at a flow rate of 150 cc/min. As a result, there was obtained 7.1 g of a carbon filament in a zone having a temperature of 600° to 1200° C. Branched filaments were little formed. Most of the obtained filaments had a diameter in the range of about 1 to 3 μm and a length in the range of 3 to 6 mm, and crimped filaments (3 to 5 crimps, crimping degree of 25%) were much contained therein. As a result of the examination with an electron microscope, it was found that carbon layers are arranged in parallel with the longitudinal axis of the filament in the form of growth rings.

EXAMPLE 3

Substantially the same procedures as in Example 2 were repeated except that the outlet of the pipe 9 was shifted to a side of much higher temperature and arranged at a position of 620° C. As a result, there was obtained 6.4 g of a carbon filament.

The terminology "yield of carbon filament" as used in Examples 4 to 11 and Comparative Examples 1 and 2 means the amount of carbon filament obtained per a volume of 5 l of the heating zone.

EXAMPLES 4 TO 9

Figure 4:
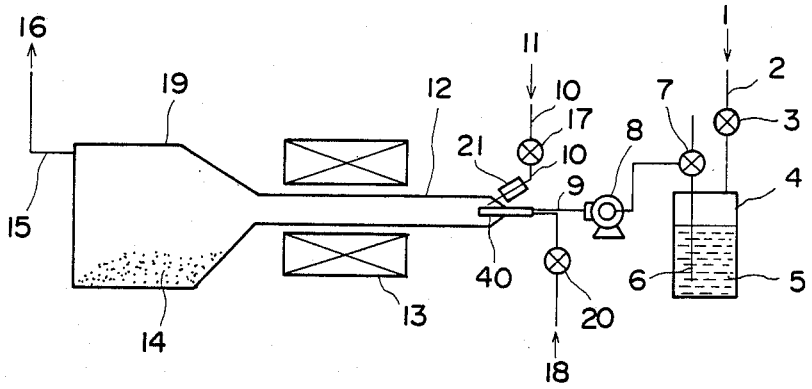
FIG. 4 is a diagrammatic view of still a further form of an apparatus used for producing a carbon filament of the present invention.

The apparatus diagrammatically shown in FIG. 4 was used. In FIG. 4, numerals 1, 11 and 18 designate inert gases, numeral 4 a tank, numeral 5 a liquid raw material, numeral 8 a constant delivery pump, numeral 12 a furnace core tube (reaction tube), numeral 13 an electric furnace, numeral 14 a carbon filament, numeral 16 an exhaust gas and numeral 40 a nozzle. Iron carbonyl of the formula $Fe(CO)_5$ was dissolved in benzene at concentrations given in Table 1, and the resulting solutions were used as a material solution. An alumina-based furnace core tube 12 having an inside diameter of 90 mm was mounted transversely in a tubular electric furnace 13 having a heater as shown in FIG. 4. Through the tube was inserted an alumina-based pipe having an inside diameter of 6 mm for the introduction of the material solution. The space temperature (introduction temperature) at the end of the nozzle and the center temperature of the furnace were controlled as given in Table 1. The other end of the pipe was placed outside the furnace and connected to a hydrogen gas-introducing pipe and a constant delivery pump. To the constant delivery pump was fed the material solution by applying pressure with an inert gas as shown in FIG. 1. Moreover, through the material introduction side was passed a pipe having the same diameter so that an inert gas to be used for the replacement of the atmosphere inside the furnace and/or a carrier gas (hydrogen gas) 11 could be introduced. These gases can be freely heated by means of a pre-heater 21. On the other hand, there was provided an inner pipe 15 within a heat resistant chamber so that an exhaust gas 16 could be discharged.

After the replacement of the inside atmosphere of the furnace with inert gases 11 and 18, the gases were switched to hydrogen gas. The introduction temperature behind the pipe outlet 9 and the temperature around the center of the furnace were elevated so that temperatures as given in Table 1 could be achieved. While introducing hydrogen gas at various flow rates as given in Table 1, the material solution was charged at a flow rate of 2.5 ml/min for 20 minutes and allowed to react. Yields and forms of the obtained carbon filaments are shown in Table 1.

The terminology "yield of carbon filaments" as used herein means the amount of carbon filaments obtained per a volume of 5 l of the heating zone.

EXAMPLE 10

Substantially the same procedures as in Example 4 were repeated except that a material solution containing a nickel carbonyl compound of the formula $Ni(CO)_4$ dissolved in a concentration of 4% by weight was used for preparing carbon filaments. Results are shown in Table 1.

EXAMPLE 11

Figure 5:
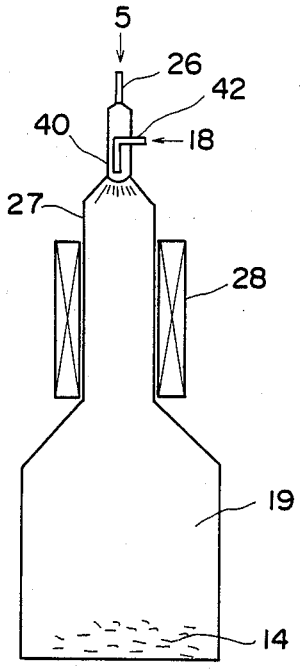
FIG. 5 is a diagrammatic view of still a further form of an apparatus used for producing a carbon filament of the present invention.

Substantially the same procedures as in Example 4 were repeated except that a vertical apparatus as shown in FIG. 5 and a material solution containing an iron carbonyl compound of the formula $Fe(CO)_5$ dissolved in a concentration of 1% by weight were used for preparing carbon filaments. Results are shown in Table 1.

In FIG. 5, numeral 5 designates a liquid raw material, numeral 14 a carbon filament, numeral 18 a gas, numeral 27 a furnace core tube, numeral 28 an electric furnace and numeral 40 a nozzle.

COMPARATIVE EXAMPLES 1 AND 2

Substantially the same procedures as in Example 4 were repeated except that the catalyst was used at concentrations of 12% by weight (Comparative Example 1) and $10^{-3}$% by weight (Comparative Example 2) for preparing carbon filaments. Results are shown in Table 1. The yield was low in each case, and the product was contaminated by soot especially in case of Comparative Example 2.

TABLE 1

| | Apparatus | Catalyst Kind | Catalyst concentration % by weight | Flow rate of $H_2$ (cm/min.) | Introduction temperature (°C.) | Temperature around the center of furnace (°C.) | Yield of carbon filament (g) | Length of carbon filament (mm) | Diameter of carbon filament (μm) | Remarks |
|---|---|---|---|---|---|---|---|---|---|---|
| Example 4 | FIG. 4 | $Fe(CO)_5$ | 3 | 50 | 300 | 1300 | 18.2 | 2–4 | 2–3 | |
| Example 5 | " | " | " | 60 | 350 | 1600 | 19.1 | " | " | |
| Example 6 | " | " | " | 50 | " | 1100 | 11.0 | " | " | |
| Example 7 | " | " | " | " | 400 | 1300 | 18.1 | " | " | |
| Example 8 | " | " | 0.1 | 250 | " | " | 9.2 | " | 3–4 | |
| Example 9 | " | " | 4 | 12 | 200 | " | 8.8 | 1–3 | 0.1–0.5 | marked crimping |
| Example 10 | " | $Ni(CO)_4$ | 4 | 50 | 50 | " | 15.0 | 1–3 | 2–3 | |
| Example 11 | FIG. 5 | $Fe(CO)_5$ | 1 | " | " | " | 17.9 | 2–4 | " | |
| Comparative Example 1 | FIG. 4 | " | 12 | 50 | 500 | 1300 | 3.9 | 2–4 | " | |
| Comparative Example 2 | " | " | $5 \times 10^{-3}$ | " | " | " | 2.5 | " | " | contaminated by soot |

In the following Examples, and Comparative Examples, the terminology "yield of carbon filament" means the amount (g) of carbon filaments produced per one minute.

EXAMPLES 12 TO 23 AND COMPARATIVE EXAMPLES 3 TO 4

A β-diketone metal complex (iron acetylacetonate or iron or nickel hexafluoroacetylacetonate) shown in Table 2 as a catalyst was dissolved in benzene in a predetermined concentration. The resulting solution was used as a material solution.

Figure 7:
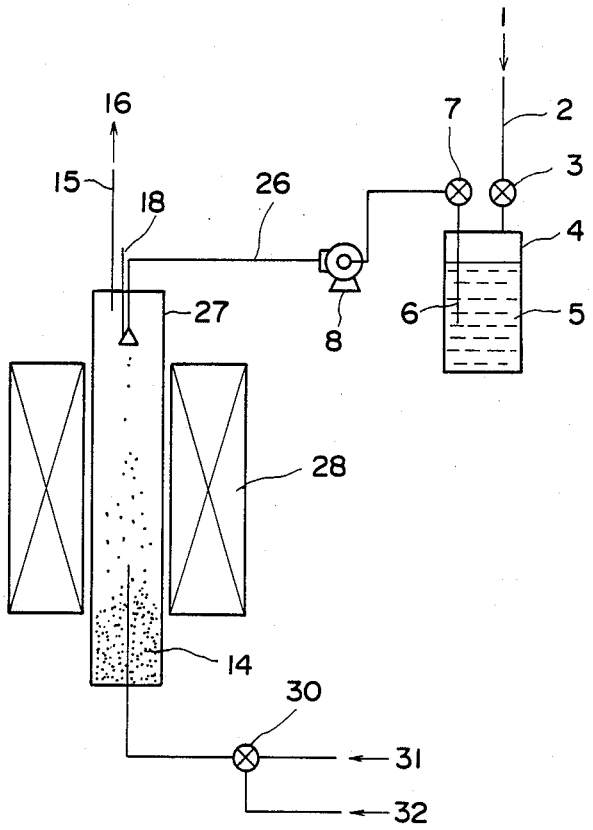
FIG. 7 is a diagrammatic view of still a further form of an apparatus used for producing a carbon filament of the present invention.

An alumina-based furnace core tube having an inside diameter of 90 mm was mounted transversely or vertically in a tubular electric furnace having a heater as shown in FIG. 6 or FIG. 7. The both ends of the tube were sealed with rubber stoppers. Through one of the stoppers was inserted an alumina-based pipe having an inside diameter of 6 mm for the introduction of the material solution. In the furnace, the space temperature (introduction temperature) at one end of the pipe and the center temperature of the furnace were controlled as given in Table 2. The other end of the pipe was placed outside the furnace and connected to a constant delivery pump using a rubber tube. Into the constant delivery pump was fed the material solution by applying pressure with an inert gas as shown in FIG. 1. Moreover, through the rubber stopper on the material introduction side was passed a pipe having the same diameter so that an inert gas 18 to be used for the replacement of the atmosphere inside the furnace and a hydrogen gas 11 could be introduced. These gases could be freely switched by means of a valve 17. On the other hand, an alumina-based pipe having an inside diameter of 6 mm was mounted through the rubber stopper on the other end so that an exhaust gas 16 could be discharged.

After the replacement of the inside atomosphere of the furnace with an inert gas 18, the gas was switched to a preheated hydrogen gas 11, and subjected to temperature elevation so that the introduction temperature at the pipe outlet 9 and the furnace center temperature as given in Table 2 could be achieved. While introducing hydrogen gas at various flow rates as given in Table 2, the material solution was charged at a flow rate of 2 ml/min for about 5 minutes and allowed to react. There were obtained crimped carbon filaments having a length of 0.5 to 3 mm and a diameter of 0.5 to 4 μm. Yields and forms of the obtained carbon filaments are shown in Table 2.

TABLE 2

| | | Catalyst | | Gas flow rate | | Introduction |
|---|---|---|---|---|---|---|
| | Apparatus | kind | Concentration % by weight | $H_2$ ($cm^3$/min) | $N_2$ ($cm^3$/min) | temperature (°C.) |
| Example 12 | FIG. 6 | $Fe(acac)_3$*1 | 2 | 800 | 0 | 380 |
| Example 13 | " | " | " | 500 | " | " |
| Example 14 | " | " | 1 | 400 | " | 300 |
| Example 15 | " | " | " | 250 | 0 | " |
| Example 16 | " | " | 3 | 250 | 1000 | 350 |
| Example 17 | " | " | $5 \times 10^{-2}$ | 1000 | 0 | " |
| Example 18 | " | $Fe(hfa)_3$*2 | 4 | " | " | 380 |
| Example 19 | " | $Ni(hfa)_2$*2 | 0.5 | " | " | " |
| Example 20 | FIG. 7 | $Fe(ACM)_3$*4 | 1 | " | " | " |
| Example 21 | FIG. 6 | $Fe(acac)_3$ | 5 | 2000 | 0 | 140 |
| Example 22 | " | " | 4 | 150 | " | " |
| Example 23 | " | " | 2 | " | 1000 | " |
| Comparative Example 3 | " | " | $1 \times 10^{-3}$ | 2000 | 0 | " |
| Comparative Example 4 | " | " | 35 | 1000 | " | 350 |

| | Temperature around the center of furnace (°C.) | Yield*3 of carbon filament (g) | Length of carbon filament (mm) | Diameter of carbon filament (μm) | Remarks |
|---|---|---|---|---|---|
| Example 12 | 1200 | 1.05 | 0.5–1 | 1–3 | |
| Example 13 | 1600 | 0.99 | " | " | |
| Example 14 | 1200 | 1.03 | " | " | |
| Example 15 | " | 1.10 | 1–2 | 2–4 | marked crimping |
| Example 16 | " | 1.06 | 0.5–1 | 1–3 | almost all straight filaments |
| Example 17 | " | 0.94 | " | " | large amount of straight filaments |
| Example 18 | " | 0.95 | " | " | |
| Example 19 | " | 0.88 | 0.1–0.5 | " | |
| Example 20 | 1300 | 1.04 | 0.5–1 | " | *4ACM: Methyl Acetoacetate |
| Example 21 | 750 | 0.11 | 0.5–1 | 1–3 | with granular by-product, large amount of straight filaments |
| Example 22 | 1900 | 0.46 | 1–2 | 2–4 | contaminated by soot |
| Example 23 | " | 0.45 | 0.5–1 | 1–3 | almost all straight filaments contaminated by soot |
| Comparative Example 3 | " | 0.20 | " | 0.2–0.3 | large amount of straight filaments contaminated by soot |
| Comparative Example 4 | 1200 | 0.32 | " | 1–3 | |

Note
*1acac: acetylacetonate
*2hfa: hexafluoroacetylacetonate
*3yield (g) of carbon filaments per min

EXAMPLE 24

Figure 8:
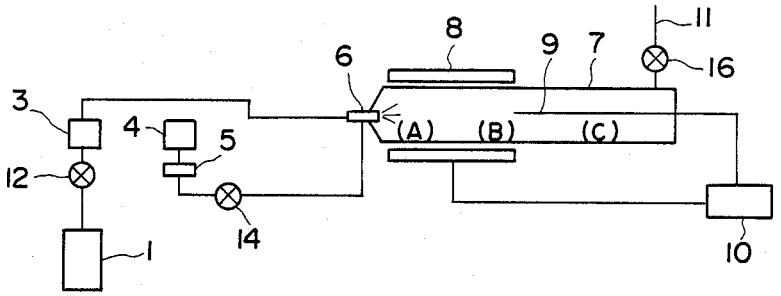
FIG. 8 is a diagrammatic view of a further form of an apparatus used for producing a carbon filament of the present invention.

An apparatus as shown in FIG. 8 which comprises a tubular electric furnace as a heating member 8 and an alumina-based furnace core tube as a reaction vessel (reaction tube) 7 was used.

First, the reaction system was flushed with hydrogen gas, and heating was initiated. A kerosine containing iron fumarate and tetrakis (triphenylphosphine) palladium (o) in concentrations of 1.0% and 0.5% by weight, respectively, was fed to a nozzle 6 by means of a constant delivery pump 5 via a valve 14. There, the kerosine was caused to meet hydrogen gas as a carrier gas which was supplied from a carrier gas-supplying source 1 through the media of a valve 12 and a flow meter 3. The kerosine entrained by the carrier gas was injected into the reaction vessel 7 from the nozzle 6. Flow rate of the carrier gas, the delivery rate of the kerosine solution, and the gas temperature at the heating zone were controlled at 800 ml/min, about 0.4 ml/min and 1000° C., respectively. Heating was stopped and the reaction tube was cooled thoroughly, and then produced carbon filaments were taken out. The product was black filaments having a diameter of 1 to 2 μm, which were mainly present in an area around portion (C) of the reaction tube 7. Black filaments having a diameter of 3 to 4 μm were formed in an area around (B) of the tube. In an area around (A) of the tube, there was also observed formation of granular carbon.

EXAMPLE 25

Figure 9:
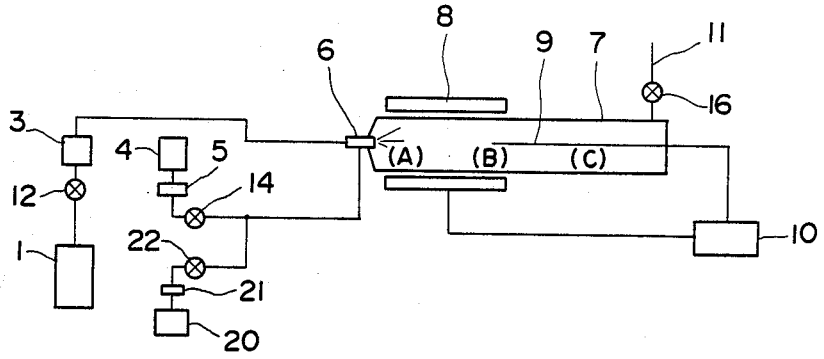
FIG. 9 is a diagrammatic view of a further form of an apparatus used for producing a carbon filament of the present invention.

An apparatus as shown in FIG. 9 which comprises a tubular electric furnace as a heating member 8 and a quartz tube as a reaction vessel (reaction tube) 7 was used.

A material solution to be used was prepared in a manner as described hereinafter. A mixture of 54.2 g (0.33 mole) of ferric chloride and 9.4 g (0.168 gram atom) of iron powder (200 mesh or less) in 200 ml of tetrahydrofuran was refluxed. After cooling, there was obtained a dispersion in which ferrous chloride $FeCl_2$ was finely dispersed. The obtained $FeCl_2$-dispersion was stored in a flask under nitrogen atmosphere. On the other hand, 50 g of naphthalene was dissolved in 250 ml of tetrahydrofuran. To the resulting solution was added 22 g of sodium and then gradually cyclopentadiene while cooling. After agitation for 1 hour, the above $FeCl_2$ dispersion was added, and the mixture was heated for about 1.5 hours. Tetrahydrofuran was partially removed from the resulting solution by subjecting to vaporization under reduced pressure to make about a 300 ml volume of the solution. The solution was filtered, and placed in a reactant solution tank 20 in FIG. 9.

The valve 22 was adjusted so that the above reactant solution was charged at a rate of 12 ml per 100 g of toluene (material to be used), and the reactant solution was mixed with toluene by means of a pump 21 and injected inside the furnace 7 from a nozzle 6 together with a mixed gas comprising a 1:1 mixture (by volume) of hydrogen and acetylene. The reaction was carried out while maintaining a temperature of 1300° C. on the heating member in the furnace. Filaments having a diameter of 3 μm were formed in an area of (B) as shown in FIG. 1. Filaments having a diameter of 1 to 2 μm were formed in an area of (C). And filaments having a diameter of 3 to 5 μm were formed in an area of (A) in a small quantity.

EXAMPLE 26

A 0.5% by weight dispersion of iron fumarate in toluene was prepared as a raw material for preparation of a carbon filament. The dispersion was charged into the tank 4 as indicated in FIG. 7. A pressure control valve was attached to the exhaust gas pipe 15, and a pressure gauge was fixed to the rubber stopper inserted in the pipe 15 to measure the pressure inside the furnace core tube. In other respectes, substantially the same apparatus as in Example 20 was used. The furnace core tube 27 was flushed with gaseous nitrogen, and then by gaseous hydrogen, and the temperature of the center of the furnace was set at 1350° C. At that time, the temperature of the introduction part was 400° C. Filament-forming reaction was effected under the following conditions:

| | |
|---|---|
| Hydrogen gas | 3000 ml/min (at 25° C., 1 atm) |
| Raw material | 2 ml/min |
| Pressure inside furnace (adjusted by pressure control valve) | 1.0 atm |
| Time | 15 min |

As a result, 11.4 g of a carbon filament having the following properties was obtained.

| Properties of Resultant Filament: | |
|---|---|
| Number of crimps | 1 |
| Crimping degree | 4% |
| Filament diameter | 0.5–0.7 μm |
| Filament length | 1–2 mm |

EXAMPLE 27

Substantially the same procedures as in Example 26 were repeated except that the pressure inside the furnace was set at 1.2 atm. As a result, 18.3 g of a carbon filament having the following properties was obtained.

| Properties of Resultant Filament: | |
|---|---|
| Number of crimps | 2–4 |
| Crimping degree | 15%* |
| Filament diameter | 0.9–1.1 μm |
| Filament length | 1–2 mm |

*larger than that of Example 29

Figure 10:
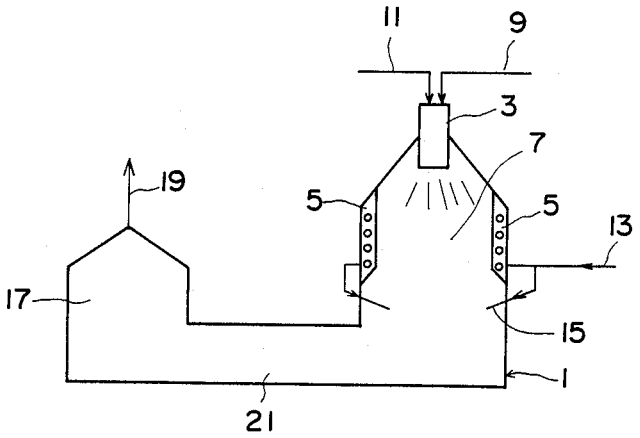
FIG. 10 is a diagrammatic view of a further form of an apparatus used for producing a carbon filament of the present invention.
Figure 11:
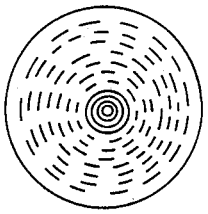
FIG. 11 is a diagrammatic enlarged cross-sectional view of a carbon filament of the present invention.
Figure 12:
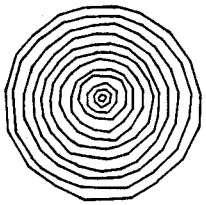
FIG. 12 is a diagrammatic enlarged cross-sectional view of a filament obtained by subjecting a carbon filament of the present invention to heat treatment at 2,700° C. for 30 minutes in an atmosphere of argon gas.
Figure 13:
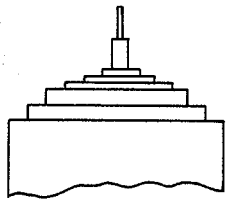
FIG. 13 is a diagrammatic side view of the broken portion of a carbon filament of the present invention.
Figure 14:
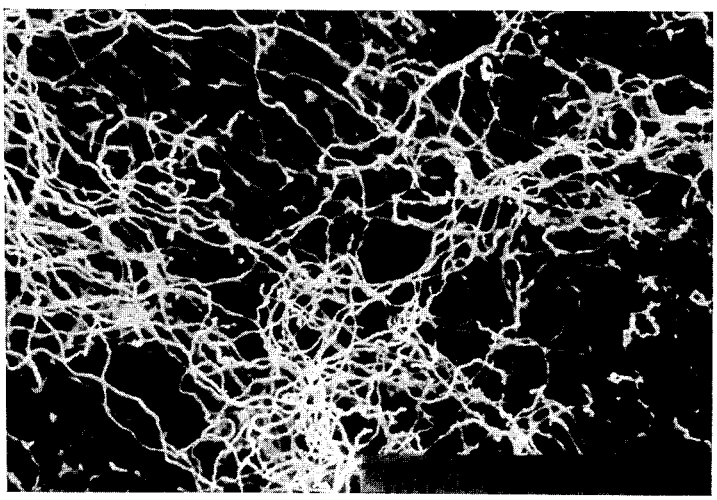
FIG. 14 is an electron microphotograph (X 550) showing one form of carbon filaments of the present invention.
Figure 15:
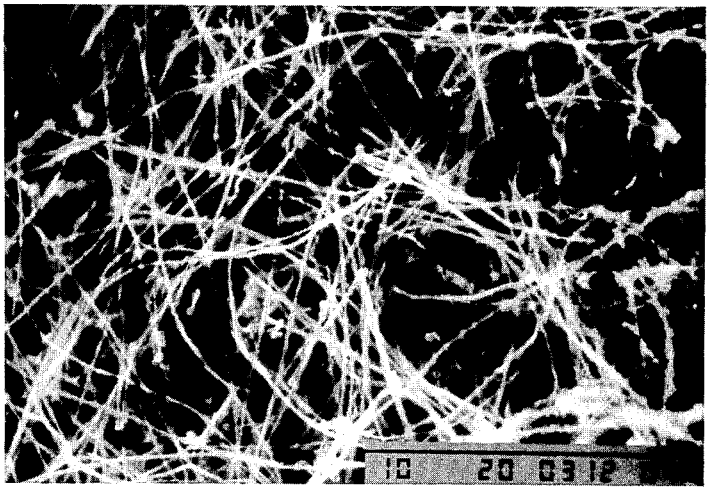
FIG. 15 is an electron micrograph (X 5000) showing another form of carbon filaments of the present invention.
Figure 16:
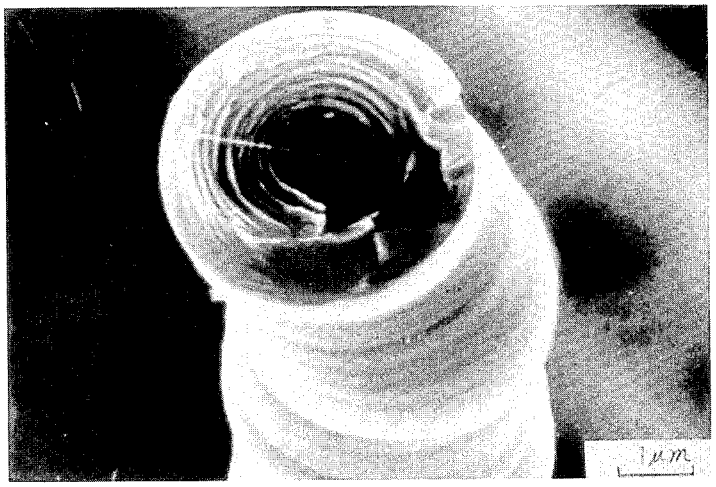
FIG. 16 is an electron micrograph (X 12500) showing a broken portion of a carbon filament of the present invention.

In the following Examples 28 to 46, an apparatus as shown in FIG. 10 was used for investigating a commercial applicability of the present invention. The apparatus comprised a reaction tower (reaction part) 7 in which a nozzle 3 (e.g. two-fluid nozzle) for injecting a material solution 11 containing a catalyst together with a gas 9 (e.g. hydrogen, argon or the like), a heater 5 and a nozzle 15 for cooling are mounted in order, and a recovering part (bag filter) 17 leading to the bottom of the reaction tower 7 through the medium of a passing member 21. In the figure, numeral 13 represents a gas (e.g. nitrogen gas) for cooling, and numeral 19 represents an exhaust gas. Specifically, an apparatus comprising a reaction tower 7 having a diameter of 210 mm and a heater having a length of 3 m in terms of the heating part was used.

EXAMPLE 28

A mixture prepared by adding 0.5% by weight of pentacarbonyl iron and 0.1% by weight thioacetic acid salt of iron to styrene was injected from a nozzle 3 into the inside of the reaction tower 7 using as a carrier gas a mixed gas comprising 50% by volume of hydrogen and 50% by volume of argon. The area near the heating part in the furnace was kept at a temperature of 1050° C., and the injection was so controlled that the injected material didn't come into direct collision with the heater 5. From the nozzle 15 at the bottom of the reaction tower 7 was injected nitrogen gas as a cooling gas to cool the formed carbon filaments and cause the formed carbon filaments to be collected in the bag filter 17 through the medium of the passing member 21. The reaction was carried out for 30 minutes while controlling flow rates of the styrene material solution, hydrogen-argon mixed gas and cooling gas at 12 g/min, 1.5 l/min and 1 l/min, respectively. 83 g of carbon filaments was obtained.

EXAMPLE 29

Substantially the same procedures as in Example 28 were repeated except that a mixture of carbon dioxide, argon and hydrogen (1% by volume, 49% by volume, 50% by volume, respectively) was used as a mixed gas. 211 g of carbon filaments was obtained.

EXAMPLE 30

Substantially the same procedures as in Example 28 were repeated except that a mixture of steam and hydrogen (0.1% by volume and 99.9% by volume) was used as a mixed gas. 202 g of carbon filaments was obtained.

EXAMPLE 31

Substantially the same procedures as in Example 28 were repeated except that a mixture of oxygen, nitrogen and hydrogen (5% by volume, 45% by volume and 50% by volume, respectively) was used as a mixed gas. 223 g of carbon filaments was obtained.

EXAMPLES 32 TO 37

Substantially the same procedures as in Example 28 were repeated except that styrene containing a sulfur compound was used and that the temperature near the heating part was kept at 1200° C. to find the effect of the sulfur compounds on the yield of carbon filaments. Results are summerized in Table 3.

EXAMPLES 38 TO 42

Substantially the same procedures as in Example 28 were repeated except that toluene containing 0.5% by weight of ferrocene and a phosphorus compound as given in Table 4 was used as a material, and a mixed gas of nitrogen and hydrogen (70% by volume and 30% by volume, respectively) was used as a carrier gas. Results are shown in Table 4.

TABLE 3

| | Sulfur compounds | | | | |
|---|---|---|---|---|---|
| | Compounds | Addition quantity (% by weight) | Yield of carbon filament (g) | Length of carbon filament (mm) | Diameter of filament (μm) |
| Example 32 | thiophene | 0.03 | 251 | 0.5–1 | 0.2 |
| Example 33 | dimethyl sulfide | 0.10 | 244 | " | " |
| Example 34 | thiophene | 0.50 | 255 | " | " |
| Example 35 | " | 3.00 | 137 | " | " |
| Example 36 | " | 0.001 | 85 | " | " |
| Example 37 | " | 15.0 | 6 | less than 0.3 | 0.1–5 |

TABLE 4

| | Phosphorus compounds | | | | |
|---|---|---|---|---|---|
| | Compounds | Addition quantity (% by weight) | Yield of carbon filament (g) | Length of filament (mm) | Diameter of filament (μm) |
| Example 38 | triphenyl phosphine | 0.05 | 203 | 0.1–1 | 0.3 |
| Example 39 | triphenyl phosphine | 1.0 | 177 | " | " |
| Example 40 | triphenyl phosphine | 7.0 | 102 | " | " |
| Example 41 | triphenyl phosphine | 0 | 75 | " | " |
| Example 42 | triphenyl phosphine | 20 | 11 | " | 1–3 |

EXAMPLES 43 TO 46

Substantially the same procedures as in Example 41 were repeated except that a toluene/ferrocene solution containing a silicon compound as given in Table 5 was used as a starting material to find the effect of silicon compounds on the yield of carbon filaments. There were obtained carbon filaments rich in straight ones. Results are shown in Table 5.

TABLE 5

| | Silicon compounds | | Yield | | |
|---|---|---|---|---|---|
| | Compounds | Addition quantity (% by weight) | of carbon filament (g) | Length of filament (mm) | Diameter of filament (μm) |
| Example 43 | tetramethyl silane | 0.05 | 158 | 0.5–1 | 0.2 |
| Example 44 | methyltrichlorosilane | 0.1 | 124 | " | " |
| Example 45 | tetramethyldisilane | 1 | 106 | " | " |
| Example 46 | tetramethylsilane | 25 | 45 | less than 0.1 | " |

EXAMPLE 47

Various carbon filaments obtained were subjected to measurement of the interlayer spacings ($d_{002}$) and crystallite size (Lc) in the direction of C-axis by the method of X-ray diffractometry, the volume of $I_{1580\,cm-1}/I_{1360\,cm-1}$ by the laser Raman spectroscopy, and the $C_{1s}$ half-width by the electron spectroscopy (ESCA). Results are summerized in Table 6.

COMPARATIVE EXAMPLE 5

A carbon filament was prepared in accordance with the method as disclosed in Japanese Patent Application Laid-Open Specification No. 57-117622/1982. The obtained carbon filament had a diameter of 10 μm. This carbon filament was subjected to measurement as described in Example 47. Results are summerized in Table 6.

COMPARATIVE EXAMPLE 6

Carbon filament was prepared in accordance with the method as disclosed in Japanese Patent Application Laid-Open Specification No. 58-214527/1983. The obtained carbon filament was subjected to measurement as described in Example 47. Results are summarized in Table 6.

TABLE 6

| | X-ray diffraction | | $I_{1580}\,cm^{-1}/I_{1360}\,cm^{-1}$ | ESCA $C_{1s}$ half width |
|---|---|---|---|---|
| | $d_{002}$ (nm) | Lc (nm) | | (eV) |
| Example 1 | 0.355 | 2.9 | 1.09 | 1.44 |
| Example 2 | 0.353 | 3.2 | 1.12 | 1.45 |
| Example 12 | 0.354 | 3.5 | 1.12 | 1.36 |
| Example 32 | 0.352 | 3.1 | 1.11 | 1.35 |
| Comparative Example 5 | 0.352 | 3.5 | about 1 | 1.75 |
| Comparative Example 6 | 0.368 | 1.3 | about 0.7 | 1.85 |

EXAMPLE 48

Each of the carbon filaments as obtained in Example 1, Example 12 and Comparative Example 6 was treated at 2400° C. for 20 minutes and subjected to measurements as indicated in Example 47. Results are shown in Table 7.

TABLE 7

| | Treatment at 2400° C. for 20 minutes | | | |
|---|---|---|---|---|
| | $d_{002}$ (nm) | $I_{1580}$ cm$^{-1}$/ $I_{1360}$ cm$^{-1}$ | Lc (nm) | ESCA $C_{1s}$ half-width (eV) |
| Example 1 | 0.342 | 2.0 | 22.3 | 1.19 |
| Example 12 | 0.343 | 2.2 | 21.1 | 1.17 |
| Comparative Example 6 | 0.347 | 1.4 | 3.2 | 1.65 |

EXAMPLE 49

The carbon filaments as obtained in Example 12 and Comparative Examples 5 and 6 were treated with 68% conc. nitric acid for periods as given in Table 8. (Treatment conditions are given in Table 8). The treated carbon filaments were washed with a water passed through an ion exhanger for 1 hour, followed by drying in an oven kept at 120° C. for 30 minutes, and then the treated filaments were subjected to measurements of the oxygen concentration ($O_{1s}/C_{1s}$) by electron spectroscopy (ESCA) and the functional groups by titration. Results are shown in Table 8.

TABLE 8

| | Conditions of conc.-$HNO_3$ treatment | | After treatment | |
|---|---|---|---|---|
| | Temperature | Period | $O_{1s}/C_{1s}$ | Titration (μeq/g) |
| Example 12 | 100° C. | 30 minutes | 0.27 | 18.3 |
| Comparative Example 5 | 120° C. | 40 minutes | 0.15 | 1.5 |
| Comparative Example 6 | 120° C. | 40 minutes | 0.20 | 2.8 |

EXAMPLE 50

Reactivity of the carbon filaments as treated in Example 49 with an epoxy resin was examined. Namely, in 500 ml of 10% (by weight) solution of Epoxy Resin (Bisphenol A type) DER661 (manufactured by Dow Chemical, U.S.A.) in xylene heated to 150° C. was immersed 5 g of the above carbon filaments treated with conc. nitric acid. After 1 hour-treatment, the filaments were separated by filtration, and the untreated epoxy resin was washed away with acetone, followed by drying under reduced pressure. The obtained filaments were weighed exactly, followed by calculation of the increase in weight (per 100 parts by weight) to determine the quantity of epoxy resin adhering to the carbon filaments. Results are shown in Table 9.

TABLE 9

| | Increase in weight (mg/g) |
|---|---|
| Example 12 | 3.8 |
| Comparative Example 5 | 0.4 |
| Comparative Example 6 | 0.4 |

EXAMPLE 51

The carbon filaments as obtained in Examples 9 and 15 were examined by scanning electron microscopy, and the number of crimps and crimping degree were determined by means of a 2000 times-enlarged photograph. From the examination of the filaments by scanning electron microscopy and transmission electron microscopy, it was found that the carbon layers were arranged in parallel with the longitudinal axis of the filament to form growth rings.

The above-mentioned carbon filaments were converted to graphite filaments by heating at 2700° C. for 10 minutes. Then, each of the above-mentioned carbon filaments and heat-treated graphite filaments was mixed with an epoxy resin and molded to give a test piece having a length of 57 mm, a width of 13 mm and a thickness of 5 mm. The epoxy resin had been prepared in a manner in which Epoxy Resin A [AFR 337 (registered trade name) manufactured and sold by Asahi Ciba Co., Ltd.] and Epoxy Resin B [EP 828 (registered trade name) manufactured and sold by Shell Co., Ltd.] were blended in a ratio of 2:1, followed by addition of 1.2 parts (relative to the epoxy resin) of an amine-based curing accelerator [ATC-3 ®; manufactured and sold by Cordova Chemical Ltd.]. and 0.9 mol % (relative to the epoxy resin) of phthalic anhydride. After blending at room temperature, the resulting mixture was maintained at 80° C. for 60 minutes, followed by incorporation of graphite filaments under agitation. Then, the graphite filaments-containing resin was incorporated in a mold and allowed to cure at 150° C. for 2 hours. The thus-prepared test piece was measured with respect to electrical resistance. Results are shown in Table 10.

TABLE 10

| | Carbon filament | | | | Carbon filament - containing resin | | Graphite filaments - containing resin | |
|---|---|---|---|---|---|---|---|---|
| | Diameter (μm) | [Length / Diameter] | No. of Crimps (number) | Crimping degree (%) | Carbon filaments/ resin | electrical resistance (Ω cm) | Graphite filaments/ resin | Electrical resistance (Ω cm) |
| Example 9 | 0.2–0.3 | 300–10000 | 3–10 | 34 | 30/70 | $3.5 \times 10^0$ | 31/69 | $3.2 \times 10^{-1}$ |
| Example 15 | 2–4 | 300–500 | 3–5 | 25 | 28/72 | $6.8 \times 10^0$ | 30/70 | $7.1 \times 10^{-1}$ |
| Comparative Example 7 | 10 | | 0 | 0 | 29/71 | $5.1 \times 10^1$ | 29/71 | $5.1 \times 10^1$ |

COMPARATIVE EXAMPLE 7

A commercially available PAN carbon filament was cut, and test pieces were prepared in a manner given in Example 51. Results are shown in Table 10.

EXAMPLES 52 TO 57

These examples are given to explain that a carbon filament having a high bulk density and a uniform form can be obtained by incorporating a binder to a grinder-processed caron filament to give one having a uniform morphology, and therefore bridging on an extruder is improved whereby the carbon filament can be dispersed evenly and easily in a matrix.

The carbon filament asobtained in Example 1 was ground using a mill provided with a rotary edge (manufactured and sold by Shibata Kagaku Sha, Japan). Grinding conditions and forms of the obtained filaments are given in Table 11. Bulk density of the obtained carbon filament and bridging on a 20ϕ-extruder (uniaxial) were also evaluated. Their results are also given in Table 11.

From the test results, it is seen that when the resulting carbon filament has a length of 1000 μm or more, its form becomes flock-like or inuniform. Moreover, when the bulk density of the carbon filament is less than 0.05 g/cm$^3$, bridging on an extruder tends to occur.

TABLE II

| | Revolutions of edge in the mill (rpm) | Grinding time (sec) | Diameter of filament (μm) | Length of filament (μm) | Form | Bulk density | Bridging extrusion characteristics |
|---|---|---|---|---|---|---|---|
| Example 52 | 10,000–20,000 | 180 | ca. 3 | 200–300 | uniform | 0.07 | good |
| Example 53 | " | 60 | " | " | " | " | " |
| Example 54 | " | 30 | " | 300–500 | " | 0.06 | " |
| Example 55 | " | 10 | " | 500–700 | " | 0.05 | fair |
| Example 56 | " | 0 | " | ca. 1000 | flock-like inuniform | 0.009 | poor |
| Example 57 | 500–1000 | 10 | " | " | flock-like inuniform | 0.02 | poor |

EXAMPLES 58 TO 60

Graphite filaments as obtained in Example 51 were immersed in a solution prepared by dissolving a polyamide resin as a bonding agent ("Tresin", trade name of a product of Teikoku Kasei Sha, Japan) in ethanol. The pickup amount was varied. The immersed filaments were dried, and ground under substantially the same conditions as in Example 50. Using the resulting filaments, the effect of the bulk density on the bridging on an extruder and extrusion properties was studied. Results are shown in Table 12.

From Table 12, it is apparent that the pickup of a bonding agent by the filaments leads to an increase in bulk density of the filaments thereby to improve the bridging on an extruder and extrusion properties.

TABLE 12

| | Graphite filament content (% by weight) | Bridging, Extrusion properties | Bulk density | Form |
|---|---|---|---|---|
| Example 58 | 1.5 | good | 0.1 | uniform |
| Example 59 | 5.2 | very good | 1.0 | " |
| Example 60 | 10.1 | " | 1.8 | " |

EXAMPLE 61

10 mg of the carbon filaments as obtained in Example 102 (as described later) was molded in a cylinder having a diameter of 10 mm under loading of 20 kg to evaluate moldability. Results are shown in Table 13.

COMPARATIVE EXAMPLE 8

A commercially available polyacrylonitrile-based carbon filament (trade name "High Carbon" manufactured and sold by Asahi Nippon Carbon Fiber Co., Ltd.) was taken out in the same quantity as in Example 61, and subjected to examination in the same manner. Results are shown in Table 13.

COMPARATIVE EXAMPLE 9

A carbon filament having a diameter of 5 to 14 μm and a length of 3 cm was produced on a substrate in accordance with the conventional gas-phase method for producing carbon filaments (see Endo and Koyama "Kogyo Zairyo" July, 1982, p.109). The filament did not show entangling properties even when it was piled in the form of non-woven fabric. The obtained mass was taken out in the same quantity as in Example 58 and subjected to examination in the same manner. Results are shown in Table 13.

TABLE 13

| | Moldability |
|---|---|
| Example 61 | moldable to form a sheet material with a shape suited for processing to a filter or the like |
| Comparative Example 8 | incapable of forming a sheet material, breaking down to pieces |
| Comparative Example 9 | incapable of forming a sheet material, breaking down to pieces |

EXAMPLES 62 TO 66

The carbon filaments as obtained in Example 4 was ground with a mill. There were obtained filament pieces having a length of 50 to 200 μm. One of the filament pieces was subjected to heat treatment at 2700° C. for 10 minutes under an argon atmosphere.

50 Parts by weight of a phenol resin [AV Lite®; manufactured and sold by Asahi Yukizai Kogyo Ltd.] was dissolved in 200 parts by weight of methyl ethyl ketone. The resulting solution was used as a binder. Namely, the above-obtained fiber pieces were mixed with the solution in a weight ratio as given in Table 14 to give paint compositions. The compositions were applied onto a glass plate. After evaporation of the solvent, electrical resistances were measured. Results are shown in Table 14.

TABLE 14

| | Weight ratio of carbon fiber/binder | Volume Resistivity (Ω cm) | Weight ratio of graphite filament/binder | Volume Resistivity (Ω cm) |
|---|---|---|---|---|
| Example 62 | 10/90 | $1.9 \times 10^0$ | 10/90 | $3.3 \times 10^{-1}$ |
| Example 63 | 30/70 | $7.3 \times 10^{-1}$ | 30/70 | $8.3 \times 10^{-2}$ |
| Example 64 | 50/50 | $3.1 \times 10^{-1}$ | 50/50 | $1.6 \times 10^{-2}$ |
| Example 65 | 5/95 | $4.8 \times 10^1$ | 5/95 | $8.3 \times 10^0$ |
| Example 66 | 70/30 | poor fluidity, inapplicable | 70/30 | poor fluidity, inapplicable |

COMPARATIVE EXAMPLE 10

40 Parts by weight of acetylene black was kneaded with 60 parts by weight of nylon-66, and injection molded to obtain test specimens. The test specimens had a volume resistivity of $9.8 \times 10^{-1}$ Ωcm.

EXAMPLES 67 TO 76

In an apparatus as shown in FIG. 5 comprising an alumina-based furnace core tube 27 having an inside diameter of 90 mm, the raw material liquid and hydrogen gas were introduced through pipes 5 and 18, respectively, into the tube, thereby causing the liquid to be injected into the tube. The raw material liquid consisted of toluene as the carbon source and a catalyst dissolved or dispersed in the toluene as indicated in Table 15.

More specifically, first, the air inside the furnace core tube 27 was replaced by a nitrogen gas. Next, the tube was heated to 1300° C. Then, a hydrogen gas was introduced through the pipe 18 to replace the nitrogen gas. The hydrogen gas was allowed to flow at a constant rate as indicated in Table 15. On the other hand, the raw material liquid was injected through the pipe 5 for a period of 15 min. Thereafter, the furnace core tube was cooled down to room temperature. The yield (g) of obtained carbon filaments 14 was measured, and the results were as shown in Table 15.

TABLE 15

| | Catalyst | | $H_2$ gas | Yield of carbon | Diameter of carbon | Length of carbon | |
|---|---|---|---|---|---|---|---|
| | Kind | Concentration (% by weight) | flow rate ($cm^3$/min) | filament (g) | filament (μm) | filament (mm) | Remarks |
| Example 67 | Fe.thioacetate | 3 | 800 | 7.9 | 0.1 | 1–2 | |
| Example 68 | Fe.methoxide | 3 | 1,000 | 5.1 | 0.1 | 0.01 | |
| Example 69 | Fe.phenoxide | 1 | 800 | 7.5 | 0.2 | 0.05 | |
| Example 70 | Fe.thioethoxide | 2 | 2,000 | 8.5 | 0.1 | 1–3 | |
| Example 71 | Fe.thiophenoxide | 0.1 | 300 | 8.3 | 0.2–0.3 | 1–3 | Crimped filaments found |
| Example 72 | Co.naphthenate | 5 | 3,000 | 6.1 | 0.1 | 0.1–1 | |
| Example 73 | Fe.thioacetate | 0.1 | 1,500 | 6.4 | " | " | |
| Example 74 | " | 0.01 | " | 5.1 | " | " | |
| Example 75 | " | 10 | " | 4.6 | " | " | |
| Example 76 | " | " | 5,000 | 3.8 | " | " | |

EXAMPLES 77 TO 93

In an apparatus as shown in FIG. 10, carbon filaments were produced in substantially the same manner as described in Example 28, except that a hydrogen gas was used as the carrier gas and that the salt and complex catalysts were used in combination with the filament-forming auxiliaries as set forth in Table 16. The test results were as indicated in Table 16.

TABLE 16

| | Catalyst | | $H_2$ gas | Furnace | Filament-forming auxiliary | | Yield of carbon | |
|---|---|---|---|---|---|---|---|---|
| | Kind | Concentration (% by weight) | flow rate ($cm^3$/min) | temperature (°C.) | Kind | Concentration (% by weight) | filament (g) | Remarks |
| Example 77 | Ferrocene | 2 | 3000 | 1200 | — | 0 | 26 | Contaminated by soot |
| Example 78 | Co.naphthenate | " | " | " | — | 0 | 79 | |
| Example 79 | Fe.thiophenoxide | " | " | " | — | 0 | 85 | |
| Example 80 | Fe.phenoxide | " | " | " | — | 0 | 60 | |
| Example 81 | Ferrocene | 1 | 5000 | 1300 | dimethyl sulfide | 1 | 127 | |
| Example 82 | Co.naphthenate | " | " | " | thiophene | " | 181 | |
| Example 83 | " | " | " | " | thiophene, triphenyl-phosphine | 0.5 0.5 | 154 | Crimped filaments mostly, Crimping degree 2.9% |
| Example 84 | Fe.thiophenoxide | " | " | " | dimethyl sulfoxide | 0.5 | 198 | |
| Example 85 | " | " | " | " | thiophene | " | 215 | |
| Example 86 | Fe.ethoxide | " | " | " | — | 0 | 51 | |
| Example 87 | " | " | " | " | methylthiol | 0.5 | 158 | |
| Example 88 | Fe.thioacetate | " | " | " | — | 0 | 96 | |
| Example 89 | " | " | " | " | thiophene | 0.5 | 229 | |
| Example 90 | Fe.(acac)$_3$*1 | " | " | " | — | 0 | 76 | |
| Example 91 | " | " | " | " | thiophene | 1 | 210 | |
| Example 92 | Fe.(ACM)$_3$*2 | " | 7000 | " | " | " | 203 | |
| Example 93 | " | " | " | " | thiophene, tetramethyl silane | 0.5 0.5 | 184 | Straight filaments mostly |

Note
*1acac: acetylacetonate
*2ACM: methyl acetoacetate

EXAMPLE 94

A mixture prepared by adding 0.8% by weight of Fe.thioacetate to styrene was injected from a nozzle 3 into the inside of the reaction tower 7 using as a carrier gas a mixed gas comprising 50% by volume of hydrogen and 50% by volume of argon. The area near the heating part in the furnace was kept at a temperature of 1250° C., and the injection was so controlled that the injected material did not come into direct collision with the heater 5. From the nozzle 15 at the bottom of the reaction tower 7 was injected a nitrogen gas as a cooling gas to cool the formed carbon filaments and cause the formed carbon filaments to be collected in the bag filter 17 through the medium of the passing member 21. The reaction was carried out for 30 minutes while controlling flow rates of the styrene material solution, hydrogen-argon mixed gas and cooling gas at 12 g/min, 1.5 l/min and 1 l/min, respectively. 87 g of carbon filaments was obtained.

EXAMPLE 95

Substantially the same procedures as in Example 94 were repeated except that a mixture of carbon dioxide, argon and hydrogen (1% by volume, 49% by volume, 50% by volume, respectively) was used as a mixed gas. 232 g of carbon filaments was obtained.

EXAMPLES 96 TO 101

Substantially the same procedures as in Example 94 were repeated except that styrene containing a sulfur compound was used and that the temperature near the heating part was kept at 1200° C. to find the effect of the sulfur compounds on the yield of carbon filaments. Results are summarized in Table 17.

TABLE 17

| | Sulfur compounds | | | | |
|---|---|---|---|---|---|
| | Compounds | Addition quantity (% by weight) | Yield of carbon filament (g) | Length of carbon filament (mm) | Diameter of filament (μm) |
| Example 96 | thiophene | 0.03 | 245 | 0.5–1 | 0.2 |
| Example 97 | dimethyl sulfide | 0.10 | 241 | " | " |
| Example 98 | thiophene | 0.50 | 256 | " | " |
| Example 99 | dimethyl sulfoxide | 3.00 | 132 | " | " |
| Example 100 | thiophene | 0.001 | 81 | " | " |
| Example 101 | thiophene | 15.0 | 3 | less than 0.3 | 0.1–5 |

EXAMPLE 102

Substantially the same procedures as described in Example 15 were repeated except that a net of tungsten (Tyler mesh: 100) was set at the center of the furnace tube maintained at 1200° C. in a direction perpendicular to the lengthwise direction of the tube. An a result, a mass form of carbon filaments was produced in locations within the tube where the temperature was in the range of from 1000° to 1200° C. The bulk density of the mass form was 0.03 g/cm$^3$. A portion of the mass form which was cut off with a knife was subjected to an immersion test in silicone oil. It was found that 1 g of the mass form retained about 41 g of silicone oil. Therefore, it can be fiarly concluded that the mass form exhibits an excellent oil retention.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A process for producing a carbon filament which comprises:

supplying to a heating zone at least one member selected from the group consisting of hydrocarbons and derivatives thereof composed mainly of carbon atoms and hydrogen atoms, the number of said carbon atoms being not more than 20 per molecule of the hydrocarbons and derivatives thereof; and heating said at least one member in the presence of an organic transition metal compound at a temperature of from 400° to 3000° C. in said heating zone, said organic transition metal compound having a metal-carbon bond and being employed in an amount of from 0.01 to 5% relative to the weight of said at least one member, said organic transition metal compound being a member selected from the group consisting of cyclopentadienyl, carbonyl, benzene, alkyl, allyl and alkynl compounds of a transition metal selected from the group consisting of Ti, Zr, V, Cr, Mo, W, Mn, Fe, Co, Ni, Ru, Rh, Pd, Os, Ir and Pt, a liquid reaction product obtained by the reaction between a halogenated transition metal compound and cyclopentadiene in the presence of a basic substance, and in mixtures thereof, said organic transition metal compound being introduced into the heating zone in the form of a liquid or a gas.

2. A process according to claim 1, wherein said organic transition metal compound is present in the heating zone in the form of a mixture there of with a filament-forming auxiliary, said filament-forming auxiliary is at least one member selected from the group consisting of silicon compounds, organic sulfur compounds and phosphorus compounds, said filament-forming auxiliary being employed in an amount of from 0.01 to 10% relative to the weight of said at least one member.

3. A process according to claim 1, wherein said organic transition metal compound is introduced into the heating zone in the form of a homogenous mixture thereof with part or all of said at least one member.

4. A process according to claim 1, wherein said organic transition metal compound is introduced into the heating zone in the form of a homogenous solution thereof in part or all of said at least one member.

5. A process according to claim 1, wherein said temperature is in the range of from 800° to 1800° C.

6. A process according to claim 1, wherein said heating is effected for a period of from $10^{-2}$ to 1000 sec.

7. A process according to claim 1, wherein said organic transition metal compound is at least one member selected from the group consisting of organic compounds of Fe, Co and Ni.

8. A process according to claim 1, wherein said at least one member is entrained in the heating zone by a carrier gas.

9. A process according to claim 8, wherein said carrier gas is at least one member selected from the group consisting of inert gases and reducing gases.

10. A process according to claim 1, wherein said filament-forming auxiliary is an organic sulfur compound.

11. A process for producing a carbon filament which comprises:

supplying to a heating zone at least one member selected from the group consisting of hydrocarbons and derivatives thereof composed mainly of carbon atoms and hydrogen atoms, the number of said carbon atoms being not more than 20 per molecule of the hydrocarbons and derivatives thereof, heating said at least one member in the presence of a transition metal salt or complex at a temperature of from 400° to 3000° C. in said heating zone, said transition metal salt or complex being employed in an amount of from 0.01 to 10% relative to the weight of said at least one member, said transition metal salt or complex having a metal-oxygen bond and/or a metal-sulfur bond and being prepared from a transition metal and an organic compound, said transition metal having an atomic number of from 22 to 30 and from 40 to 48 and being a member selected from the group consisting of Ti, V, Cr, Mn, Co, Ni, Fe, Cu, Zr, Nb, Mo, Tc, Ru, Rh, Pd, and mixtures thereof, said transition metal salt or complex being introduced into the heating zone in the form of a liquid or a gas.

12. A process according to claim 11, wherein said transition metal salt or complex is at least one member selected from the group consisting of transition metal carboxylic salts, transition metal thiocarboxylic salts, transition metal β-diketone complexes, transition metal β-ketonic ester complexes, transition metal alkoxides, transition metal phenoxides, transition metal thioalkoxides and transition metal thiophenoxides.

13. A process according to claim 11, wherein said transition metal salt or complex is present in the heating zone in the form of a mixture thereof with a filament-forming auxiliary, said filament-forming auxiliary is at least one member selected from the group consisting of silicon compounds, organic sulfur compounds and phosphorus compounds, said filament-forming auxiliary being employed in an amount of from 0.01 to 10% relative to the weight of said at least one member.

14. A process according to claim 13, wherein said filament-forming auxiliary is an organic sulfur compound.

15. A process according to claim 11, wherein said transition metal salt or complex is introduced into the heating zone in the form of a homogeneous solution or dispersion thereof in part or all of said at least one member selected from the group consisting of hydrocarbons and derivatives thereof.

16. A process according to claim 15, wherein said homogeneous solution or dispersion is injected into the heating zone.

17. A process according to claim 11, wherein said temperature is in the range of from 800° to 1800° C.

18. A process according to claim 11, wherein said heating is effected for a period of from $10^{-2}$ to 1000 sec.

19. A process according to claim 11, wherein said transition metal salt or complex is at least one member selected from the group consisting of salts and complexes of Fe, salts and complexes of Co and salts and complexes of Ni.

20. A process according to claim 17, wherein said transition metal salt or complex is at least one member selected from the group consisting of transition metal β-diketone complexes and transition metal β-ketonic ester complexes.

21. A process according to claim 11, wherein said at least one member selected from the group consisting of hydrocarbons and derivatives thereof is entrained in the heating zone by a carrier gas.

22. A process according to claim 21, wherein said carrier gas is at least one member selected from the group consisting of inert gases and reducing gases.

23. A process according to claim 1, wherein said number is not more than 14 per molecule of the hydrocarbons and derivatives thereof.

24. A process according to claim 1, wherein said organic transition metal compound is a member selected from the group consisting of cyclopentadienyl and carbonyl compounds of a transition metal selected from the group consisting of Ti, Zr, V, Cr, Mo, W, Mn, Fe, Co, Ni, Ru, Rh, Pd, Os, Ir and Pt, and a liquid reaction product obtaind by the reaction between a halogenated transition metal compound and cyclopentadiene in the presence of a basic substance.

25. A process according to claim 11, wherein said number is not more than 14 per molecule of the hydrocarbons and derivatives thereof.

* * * * *